US011412812B2

(12) United States Patent
Barnes et al.

(10) Patent No.: US 11,412,812 B2
(45) Date of Patent: Aug. 16, 2022

(54) ARTICLES OF FOOTWEAR WITH ASYMMETRICAL SEGMENTED PLATES

(71) Applicant: NIKE, Inc., Beaverton, OR (US)

(72) Inventors: Leslie Barnes, Portland, OR (US); Thomas G. Bell, Portland, OR (US); Dustin Hatfield, San Francisco, CA (US); John Hurd, Lake Oswego, OR (US); Troy C. Lindner, Portland, OR (US); Geng Luo, Portland, OR (US); Gordon A. Valiant, Beaverton, OR (US); Jay T. Worobets, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 24 days.

(21) Appl. No.: 16/984,313

(22) Filed: Aug. 4, 2020

(65) Prior Publication Data

US 2020/0359740 A1 Nov. 19, 2020

Related U.S. Application Data

(62) Division of application No. 15/376,104, filed on Dec. 12, 2016, now Pat. No. 10,750,817.
(Continued)

(51) Int. Cl.
*A43B 13/14* (2006.01)
*A43B 5/06* (2022.01)
(Continued)

(52) U.S. Cl.
CPC ..... *A43B 13/141* (2013.01); *A43B 3/0094* (2013.01); *A43B 5/02* (2013.01); *A43B 5/06* (2013.01); *A43B 13/026* (2013.01)

(58) Field of Classification Search
CPC ..... A43B 13/141; A43B 13/16; A43B 13/22; A43B 13/223; A43B 13/226; A43B 13/188; A34B 5/001
See application file for complete search history.

(56) References Cited

U.S. PATENT DOCUMENTS 3,626,611 A 12/1971 Louis
3,748,756 A 7/1973 White
(Continued)

FOREIGN PATENT DOCUMENTS

CN 102631049 A 8/2012
EP 2380451 A1 * 10/2011 ..... A43B 13/188
(Continued)

OTHER PUBLICATIONS

"Anzen-tabi non slip sole work boots shoes for men mountain walking" Aug. 16, 2014 <http://www.alibaba.com/cache/Anzen-tabi-non-slip-sole-work_138059115.html>.
(Continued)

*Primary Examiner* — Megan E Lynch
(74) *Attorney, Agent, or Firm* — Banner & Witcoff, Ltd.

(57) ABSTRACT

A pair of sole plates for a complementary pair of articles of footwear may generally include a first article with a first sole plate and a second article with a second sole plate, where the first sole plate is asymmetrical with respect to the second sole plate. The first sole plate includes a first groove that extends along a first lateral side of the first sole plate, and the second sole plate includes a second groove that extends along a second medial side of the second sole plate. The asymmetry of first sole plate with respect to second sole plate may improve performance, flexibility, and agility during running and in particular, during athletic events along a curved track.

20 Claims, 14 Drawing Sheets

Related U.S. Application Data

(60) Provisional application No. 62/276,602, filed on Jan. 8, 2016.

(51) Int. Cl.

| | |
|---|---|
| ***A43B 3/00*** | (2022.01) |
| ***A43B 5/02*** | (2006.01) |
| ***A43B 13/02*** | (2022.01) |

(56) References Cited

U.S. PATENT DOCUMENTS

| | | | | |
|---|---|---|---|---|
| 4,527,345 | A * | 7/1985 | Lopez Lopez | A43B 3/0094 36/127 |
| 4,559,724 | A * | 12/1985 | Norton | A43B 5/06 36/114 |
| 4,754,561 | A | 7/1988 | Dufour | |
| 5,329,704 | A | 7/1994 | Martin, Jr. | |
| 5,384,973 | A * | 1/1995 | Lyden | A43B 13/12 36/102 |
| 5,729,912 | A | 3/1998 | Gutkowski et al. | |
| 5,752,332 | A | 5/1998 | Kataoka et al. | |
| 6,158,151 | A | 12/2000 | Won | |
| 6,430,847 | B2 | 8/2002 | Fusco et al. | |
| 6,692,454 | B1 | 2/2004 | Townsend et al. | |
| 6,857,205 | B1 * | 2/2005 | Fusco | A43B 5/00 36/102 |
| 6,954,998 | B1 * | 10/2005 | Lussier | A43B 5/02 36/107 |
| 7,254,905 | B2 | 8/2007 | Dennison | |
| 7,441,350 | B2 | 10/2008 | Auger et al. | |
| 7,533,476 | B2 | 5/2009 | Hay | |
| 7,634,861 | B2 | 12/2009 | Kilgore | |
| 7,832,117 | B2 | 11/2010 | Auger et al. | |
| 9,591,891 | B1 * | 3/2017 | Baucom | A43B 13/12 |
| 2001/0007181 | A1 * | 7/2001 | Cagner | A43D 9/00 36/102 |
| 2004/0111920 | A1 * | 6/2004 | Cretinon | A43B 13/12 36/30 R |
| 2006/0277799 | A1 * | 12/2006 | Lebo | A43B 13/026 36/102 |
| 2007/0068039 | A1 * | 3/2007 | Nau | A43B 13/16 36/25 R |
| 2007/0240333 | A1 * | 10/2007 | Le | A43B 17/10 36/30 R |
| 2007/0240337 | A1 * | 10/2007 | Belluto | A43C 15/162 36/134 |
| 2008/0289220 | A1 * | 11/2008 | Rivas | A43B 13/125 36/88 |
| 2010/0031531 | A1 * | 2/2010 | Baucom | B29D 35/142 36/44 |
| 2011/0088287 | A1 * | 4/2011 | Auger | A43B 13/125 36/107 |
| 2013/0067776 | A1 * | 3/2013 | Auger | A43B 13/184 36/25 R |
| 2013/0174444 | A1 | 7/2013 | Jacobs et al. | |
| 2013/0326908 | A1 * | 12/2013 | Grott | A43B 5/001 36/62 |
| 2014/0123522 | A1 * | 5/2014 | Rustam | A43B 7/144 36/127 |
| 2014/0182169 | A1 | 7/2014 | Mack | |
| 2014/0202042 | A1 * | 7/2014 | Berend | A43C 13/04 36/25 R |
| 2014/0250723 | A1 * | 9/2014 | Kohatsu | A43B 3/26 36/88 |
| 2014/0259744 | A1 * | 9/2014 | Cooper | A43B 13/122 36/28 |
| 2015/0282557 | A1 * | 10/2015 | Kirk | A43B 3/0047 36/31 |
| 2016/0000185 | A1 * | 1/2016 | Cook | A43B 13/026 36/107 |
| 2016/0001478 | A1 * | 1/2016 | Cook | B29D 35/081 264/244 |
| 2016/0015120 | A1 * | 1/2016 | Denison | A43B 7/14 36/127 |
| 2016/0051011 | A1 * | 2/2016 | Francis | A43B 5/00 36/59 C |
| 2016/0081425 | A1 * | 3/2016 | Piontkowski | A43B 17/023 36/91 |
| 2016/0174656 | A1 * | 6/2016 | Wolfrom | A43B 13/22 36/28 |
| 2016/0219973 | A1 * | 8/2016 | Cheney | A43B 13/223 |
| 2017/0079373 | A1 * | 3/2017 | Huard | A43B 7/144 |
| 2017/0119091 | A1 * | 5/2017 | Bischoff | A43B 13/125 |
| 2017/0150782 | A1 * | 6/2017 | Moriyasu | A43B 13/122 |
| 2017/0188655 | A1 * | 7/2017 | Carlson | A63C 17/00 |

FOREIGN PATENT DOCUMENTS

| | | | |
|---|---|---|---|
| GB | 163236 | A | 5/1921 |
| GB | 326700 | A | 3/1930 |
| JP | 2005013365 | A | 1/2005 |
| WO | 2016004352 | A1 | 1/2016 |

OTHER PUBLICATIONS

Logan, Suzanna, et al. "Ground reaction force differences between running shoes, racing flats, and distance spikes in runners." Journal of sports science & medicine 9.1 (2010): 147 <https://www.ncbi.nlm.nih.gov/pmc/articles/PMC3737977/>.

Larson, Peter, et al. "Foot strike patterns of recreational and sub-elite runners in a long-distance road race." Journal of sports sciences 29.15 (2011): 1665-1673 <http://www.tandfonline.com/doi/abs/10.1080/02640414.2011.610347>.

Van Rens, B.J.E., et al. "Energy return in running surfaces." Eindhoven: Technische Universiteit Eindhoven. 46p (1994) <http://alexandria.tue.nl/repository/books/652989.pdf>.

Pang, Nick. "The Split-Toe Running Shoe: Topo Athletic RR Racing Shoe Reviewed." Natural Running Center, Jul. 21, 2013. <http://naturalrunningcenter.com/2013/07/21/topo-athletic-rr-racing-shoe-review/>.

Mar. 31, 2017—(WO) International Search Report and Written Opinion—App PCT/US2016/066816.

Feb. 10, 2021—(EP) ESR—App. No. 20208748.2.

* cited by examiner

ARTICLES OF FOOTWEAR WITH ASYMMETRICAL SEGMENTED PLATES

RELATED APPLICATION DATA

This application is a divisional application based on co-pending U.S. patent application Ser. No. 15/376,104 filed Dec. 12, 2016 and entitled "Articles of Footwear with Asymmetrical Segmented Plates," which application claims priority benefits to U.S. Provisional Patent Appln. No. 62/276,602 filed Jan. 8, 2016 and entitled "Articles of Footwear with Asymmetrical Segmented Plates." Each of U.S. patent application Ser. No. 15/376,104 and U.S. Provisional Patent Appln. No. 62/276,602 is entirely incorporated herein by reference.

FIELD

The present disclosure relates generally to articles of footwear including running shoes for track events, and methods of making an article of footwear.

BACKGROUND

Articles of footwear for sports such as running have previously been proposed. While conventional running shoes for track events generally include spikes to help give more grip, the soles are typically designed with a flexible sole. In some instances, the sole is formed of a flexible outsole.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction.

BRIEF DESCRIPTION OF THE DRAWINGS

This disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DESCRIPTION

Figure 1:
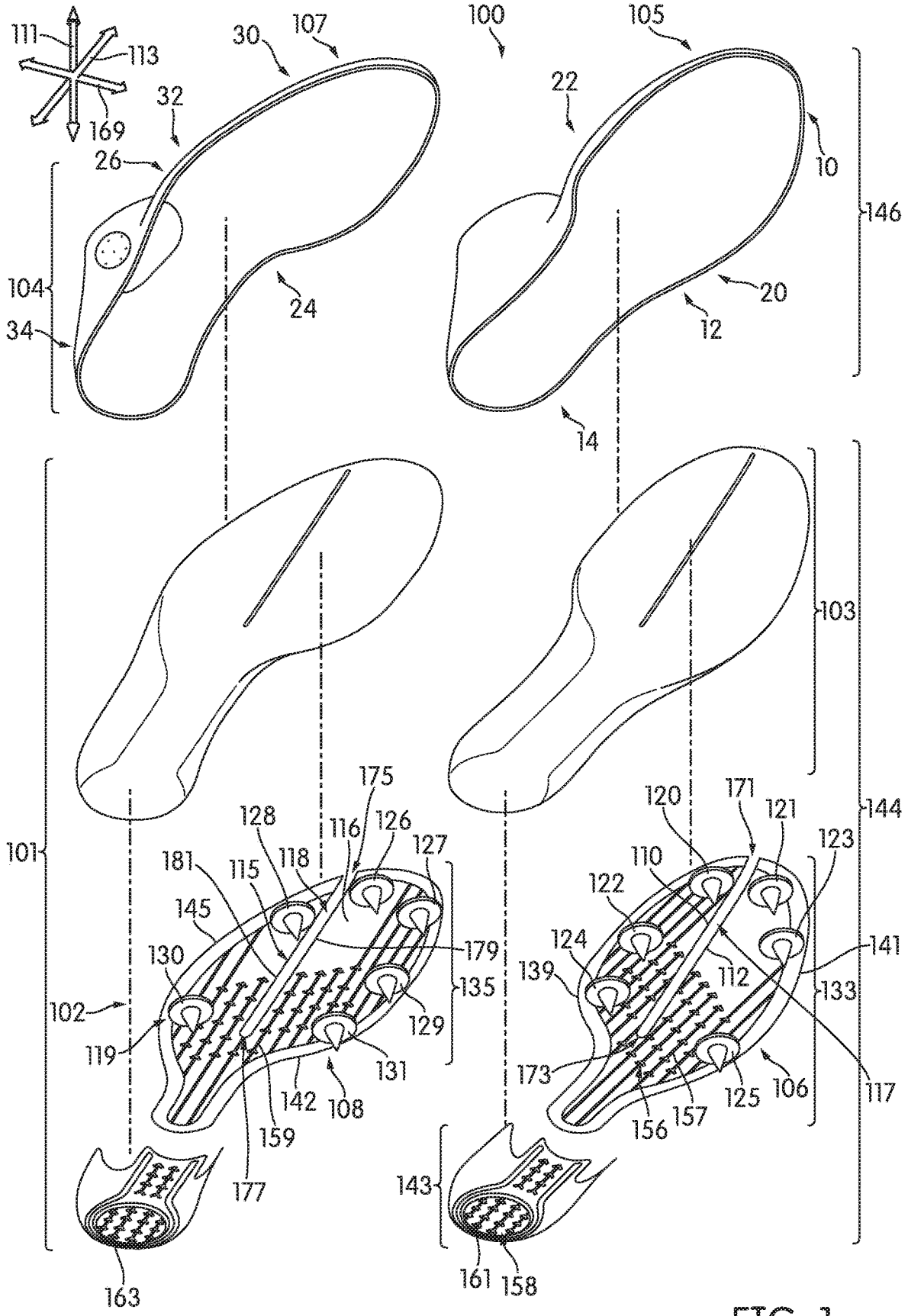
FIG. 1 is an exploded view of an embodiment of a pair of articles of footwear with asymmetrical sole plates.

Embodiments can include provisions for providing asymmetric properties to a pair of articles configured for use in activities where different properties may be needed for the two articles. In one aspect, the present disclosure is directed to a complementary pair of sole plates for use with articles of footwear comprising a first plate and a second plate, where the first plate includes a first groove that divides a forefoot portion of the first plate into a first continuous lateral plate portion and a first continuous medial plate portion. In addition, the second plate includes a second groove that divides a forefoot portion of the second plate into a second continuous lateral plate portion and a second continuous medial plate portion. Furthermore, a maximum width of the first continuous lateral plate portion is greater than a maximum width of the second continuous lateral plate portion, and a maximum width of the first continuous medial plate portion is less than a maximum width of the second continuous medial plate portion, thereby providing the pair of sole plates with an asymmetric configuration.

In another aspect, the present disclosure is directed to a complementary pair of sole plates for use with articles of footwear, comprising a first plate and a second plate, where the first plate includes a first groove that divides a forefoot portion of the first plate into a first continuous lateral plate portion and a first continuous medial plate portion. In addition, the second plate includes a second groove and a third groove, where the second groove and the third groove divide the forefoot portion of the second plate into a second continuous lateral plate portion, a first continuous intermediate plate portion, and a second continuous medial plate portion, thereby providing the pair of sole plates with an asymmetric configuration.

In another aspect, the present disclosure is directed to a complementary pair of sole plates for articles of footwear comprising a first plate and a second plate. The first plate has a first stiffness and the second plate has a second stiffness, and the first stiffness is different than the second stiffness.

The following description discusses an exemplary embodiment in the form of track shoes, but it should be noted that the present concepts may be associated with any article of footwear, including, but not limited to, basketball shoes, running shoes, track shoes, field shoes, baseball shoes, rugby shoes, and football shoes as well as possibly other kinds of shoes. The articles of footwear shown in the figures may be intended to be used with a left foot and a corresponding right foot. One object of the embodiments is to provide an athletic shoe for field and track use, especially a running shoe, which, while being as light as possible, is optimally fitted to the anatomical conditions of the foot during the run, and offers as little resistance as possible to the natural movements as the runner traverses curved portions of a running track. In some embodiments, performance along curved portions of a running track may be enhanced for a wearer, and performance on straight portions of the track can remain at a high level.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot region to a heel region of the sole. The term "longitudinal axis," as used throughout this detailed description and in the claims, refers to an axis oriented in a longitudinal direction.

The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot (i.e., the "little toe" side), and the medial side being the surface that faces toward the other foot (i.e., the "big toe" side). The term "lateral axis," as used throughout this detailed description and in the claims, refers to an axis oriented in a lateral direction.

The term "horizontal," as used throughout this detailed description and in the claims, refers to any direction substantially parallel with the longitudinal direction, the lateral direction, and all directions in between. In cases where an article is planted on the ground, a horizontal direction may be parallel with the ground. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions, along a vertical axis. For example, in cases where a sole is planted flat on a ground surface, the vertical direction may extend from the ground surface upward. It will be understood that each of these directional adjectives may be applied to individual components of a sole. Furthermore, the terms "outer surface" or "outer side," as used throughout this detailed description and in the claims, refers to the surface of a component that would be facing away from the foot when worn by a wearer. "Inner surface" or "inner side," as used throughout this detailed description and in the claims, refers to the surface of a component that is facing inward, or the surface that faces toward the foot when worn by a wearer.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "permanently attached" shall refer to two components joined in a manner such that the components may not be readily separated (for example, without destroying one or both of the components). Example modalities of permanent attachment may include joining with permanent adhesive, rivets, stitches, nails, staples, welding or other thermal bonding, and/or other joining techniques. In addition, two components may be permanently attached by virtue of being integrally formed, for example, in a molding process.

FIG. 1 illustrates an exploded view of a complementary pair of articles of footwear 100, or simply articles 100. Articles 100 may include a first article 105 and a second article 107. For purposes of this discussion, a complementary pair of articles refers to two articles of footwear which are designed to be worn as a pair by one user on a right foot and a left foot.

Articles 100 and components associated with articles 100 may be characterized as having various portions or regions associated with different portions or regions of a foot. Components described herein may include a forefoot region disposed proximate a wearer's forefoot. For example, as shown in FIG. 1, first article 105 includes a first forefoot region 10 and second article 107 includes a second forefoot region 30. Articles 100 may also include a heel region disposed proximate a wearer's heel and opposite the forefoot region. For example, first article 105 includes a first heel region 14 and second article 107 includes a second heel region 34. Articles 100 may further include a midfoot region disposed between the forefoot region and the heel region. For example, first article 105 includes a first midfoot region 12 and second article 107 includes a second midfoot region 32. It should be noted that throughout this description, the terms forefoot region, midfoot region, and heel region may be associated with the various components of an article of footwear, as well as regions of a foot.

Referring to FIG. 1, articles 100 may include a medial side and a lateral side opposite to the medial side. For example, as shown, first article 105 includes a first medial side 22 and second article 107 includes a second medial side 24. Furthermore, first article 105 includes a first lateral side 20 and second article 107 includes a second lateral side 26. It should be noted that throughout this description, the terms medial side and lateral side may be associated with the various components of an article of footwear, as well as regions of a foot.

In some embodiments, articles 100 can include a pair of sole structures and a pair of uppers. For example, first article 105 includes a first sole structure 144 and a first upper 146, and second article 107 includes a second sole structure 101 and a second upper 104. In some embodiments, first upper 146 may be attached to first sole structure 144 by any known mechanism or method. For example, first upper 146 may be stitched to first sole structure 144, or first upper 146 may be glued to first sole structure 144. First upper 146 may be configured to receive a foot. The exemplary embodiment shows a generic design for the uppers. In some embodiments, the uppers may include another type of design. For instance, first upper 146 may be a seamless warp knit tube of mesh. It should be noted that second upper 104 may be similar to first upper 146, and/or second sole structure 101 may be similar to first sole structure 144.

It should further be understood that in some embodiments, references or descriptions pertaining to first sole structure 144 may be applied to second sole structure 101. Similarly, references or descriptions pertaining to first upper 146 may be applied to second upper 104 in some embodiments. Thus, throughout the figures, while only one article of footwear or components of one article of footwear may be described in some cases, the description can be understood to apply to both a left article of footwear and a complementary right article of footwear.

Furthermore, in one embodiment, there may be sole components such as sole plates that include exposed edges associated with the medial side and the lateral side. For example, in FIG. 1, first article 105 includes a first exposed medial edge 139 on first medial side 22, and second article 107 includes a second exposed medial edge 142 on second medial side 24. Furthermore, first article 105 includes a first exposed lateral edge 141 on first lateral side 20 and second article 107 includes a second exposed lateral edge 145 on second lateral side 26.

The sole structures may include multiple components in some embodiments, which may individually and/or collectively provide articles 100 with a number of attributes, such as support, rigidity, flexibility, stability, cushioning, comfort, reduced weight, traction, and/or other attributes. For example, in some embodiments, first sole structure 144 and/or second sole structure 101 may incorporate incompressible plates, moderators, and/or other elements that attenuate forces, influence the motions of the foot, and/or impart stability, for example.

In some embodiments, each sole structure of articles 100 may include one or more sole plates 102 disposed along the bottom surface of articles 100. In different embodiments, first sole structure 144 of first article 105 may differ with respect to second sole structure 101 of second article 107. For example, first article 105 may include a first sole plate 106 ("first plate 106") and second article 107 may include a second sole plate 108 ("second plate 108"). In some embodiments, an additional sole layer disposed between each sole plate and the corresponding upper may include cushioning members, reinforcing structures, support structures, or other features. In another embodiment, midsole 103 may include a recess to hold or surround a sole plate. In one embodiment, first plate 106 can extend from first forefoot region 10 to first heel region 14 in first article 105. In another embodiment, first plate 106 can extend from first forefoot region 10 to first midfoot region 12 in first article 105.

In different embodiments, sole plates 102 may have a configuration that extends between a bottom surface of the upper and the ground in a vertical direction 111 and may be secured to the upper or another component of articles 100 in any suitable manner. For example, first plate 106 may be secured to first upper 146 by adhesive attachment, stitching, welding, or any other suitable method. Sole plates 102 may include provisions for attenuating ground reaction forces (that is, cushioning and stabilizing the foot during vertical and horizontal loading) in some embodiments. In addition, sole plates 102 may be configured to provide traction, impart stability, and/or limit various foot motions, such as pronation, supination, and/or other motions.

Further, while various types of articles 100 may be provided without a midsole, in some embodiments, first sole structure 144 may also include a midsole 103 or another sole layer disposed between first plate 106 and first upper 146. As shown in FIG. 1, midsole 103 may be disposed between first upper 146 and first plate 106. In one embodiment, a lower surface of midsole 103 may face or be joined to first plate 106, and an upper surface of midsole 103 may face or be joined to first upper 146.

Midsole 103 may be formed of various materials. For example, midsole 103 may be formed of a cushioning material such as an expanded rubber, foam rubber, polyurethane, and the like. In other embodiments, the midsole may be omitted (not shown). In one embodiment, a sole structure may optionally include a heel member 143 disposed near or along first heel region 14.

First sole structure 144 and first upper 146 may be made from materials known in the art for making articles of footwear. For example, first sole structure 144, including the sole plate, may be made from elastomers, siloxanes, natural rubber, synthetic rubbers, aluminum, steel, natural leather, synthetic leather, plastics, or thermoplastics. In another example, first upper 146 may be made from nylon, natural leather, synthetic leather, natural rubber, or synthetic rubber.

Sole plates 102 may comprise a relatively rigid material. Sole plates 102 may include carbon fiber, as well as other materials. In one embodiment, sole plates 102 may include rigid material including a woven fabric such as a carbon fiber, nylon fiber, cotton fiber, textile, elastomer fiber, animal fiber, and the like. In some embodiments, the rigid material is a substance having a high Young's modulus. For example, a high Young's modulus may be greater than 100 gigapascal (GPa), greater than 150 GPa, greater than 180 GPa, greater than 200 GPa, etc. Examples of rigid material having a high Young's modulus may include, for instance, copper, brass, bronze, steel, silicon carbide, tungsten carbide, and a single-walled carbon nanotube, as well as other materials. The rigid material can comprise carbon fiber. The rigid material can consist essentially of carbon fiber. In other embodiments, sole plates 102 may comprise more than one material, for example, a relatively rigid and a relatively flexible or elastic material.

The accompanying figures depict various embodiments of articles 100, having sole plates 102 suited for multi-directional traction on natural and/or synthetic turf and/or tracks. Articles 100, as depicted, may be suited for a variety of activities on natural and/or synthetic turf or tracks, such as agility/speed training and competition, as well as other sports, such as baseball, soccer, American football, track events, and other such activities where flexibility, traction, and grip may be significantly enhanced by sole plates 102. In addition, various features of the disclosed sole plates 102 (and/or variations of such features) may be implemented in a variety of other types of footwear.

In some cases, the incorporation of rigid material into sole plates 102 restricts flexing of articles 100 from the medial side to the lateral side and from the lateral side to the medial side. Flexing can allow the article of footwear to have improved traction by providing improved contact to a playing or running surface. Moreover, such flexing allows for a more natural feel for the wearer as he/she contacts the playing surface. Accordingly, in some embodiments, articles 100 may include one or more grooves 115, whereby the relatively rigid material of one portion of sole plates 102 is separated from another portion of sole plates 102. In some instances, flexibility in lateral direction 169 (compared to longitudinal direction 113) may be desired. In such cases, sole plates 102 may include one or more grooves 115. In FIG. 1, first plate 106 includes a first groove 117, and second plate 108 includes a second groove 118. In some embodiments, grooves 115 extend through the entire thickness of the sole plate. Furthermore, in one embodiment, grooves 115 may expose the layer adjacent to the sole plate (e.g., midsole 103). It should be understood that sole plates 102 may include additional indentations or other recesses that extend only partially through the thickness of the sole plates, and can thus differ from grooves 115.

Thus, in one embodiment, sole plates 102 are segmented to provide flexibility in a lateral direction 169. As such, a user may have an improved feel of the playing surface during an operation or use of articles 100. For example, the segmentation of first plate 106 may allow first article 105 to roll in response to an impact on first lateral side 20. Such a rolling function may be even further utilized in operations where a lateral impact onto a playing surface is common, for example, when a user is turning. In some embodiments, segmentation may be provided by inclusion of one or more grooves 115 disposed in sole plates 102.

In some cases even further flexibility in lateral direction 169 compared to longitudinal direction 113 is desired. It may be desirable to further improve flexibility in lateral direction 169, for example, in order to improve a user's comfort during turns. In such cases, grooves 115 may be extended further along sole plates 102 and/or there may be multiple grooves 115 along either first plate 106 or second plate 108.

Thus, grooves 115 may run in a generally longitudinal direction 113. In some embodiments, grooves 115 may also extend across in a lateral direction 169, or in a direction diagonal to lateral direction 169 and longitudinal direction 113. In one embodiment, grooves 115 may run such that they are extend further in longitudinal direction 113 than in lateral direction 169. This placement can enhance flexibility in lateral direction 169.

As will be discussed further below, in different embodiments, grooves 115 may have varying shapes. In one embodiment, grooves 115 may comprise relatively long and/or narrow strips forming exposed areas through sole plates 102. In one embodiment, the exposed areas may be adjacent to or expose at least a portion of the lower surface of midsole 103. In other embodiments, grooves 115 may have irregular, curved, or otherwise contoured shapes. Grooves 115 may have a shape to improve a user's comfort during turns by having an orientation angled between the medial side 22 and the lateral side 20.

In different embodiments, grooves 115 may be located in various regions of sole plates 102. In some embodiments, for example, first groove 117 may extend along first forefoot region 10. In other embodiments, first groove 117 may extend across first midfoot region 12 and/or first heel region 14. In some embodiments, first groove 117 may extend across a bottom surface 116 of sole plates 102 from first forefoot region 10 to first heel region 14.

In some embodiments, grooves 115 may include a first end and a second end. For example, first groove 117 may be substantially linear and include a first end 171 and a second end 173, and second groove 118 also may be substantially linear and include a first end 175 and a second end 177. Furthermore, in some embodiments, sole plates 102 may include various inner edges that form at least part of the perimeter defining grooves 115. In one embodiment, first groove 117 may include a first edge 110 and a second edge 112, and second groove 118 may include a first edge 179 and a second edge 181. In some embodiments, first edge 110 and second edge 112 may be joined at one or both ends. In the embodiment of FIG. 1, first edge 110 and second edge 112 are joined at second end 173 of first groove 117, and form an open space at first end 171. In one embodiment, first edge 110 and second edge 112 may extend across sole plates 102 such that the shape of first edge 110 and the shape of second edge 112 substantially correspond with one another. In other embodiments, first edge 110 and second edge 112 may comprise of non-linear and/or non-corresponding contours. Some examples of various features and properties of grooves 115 as represented in first plate 106 and second plate 108 will be discussed further below with reference to the figures. It should be noted that second groove 118 may be similar in various aspects to first groove 117. In some cases, references or descriptions pertaining to first groove 117 may be applied to second groove 118, and/or first groove 117 may be representative of grooves 115.

In addition, in different embodiments, a bottom surface 116 of sole plates 102 may be configured to contact a playing surface. For example, bottom surface 116 may be configured to contact grass, synthetic turf, a track surface, dirt, or sand. Bottom surface 116 of sole plates 102 may include provisions for increasing traction with such a playing surface. For example, as shown in FIG. 1, such provisions may include cleats 119. As shown in FIG. 1, cleats 119 are arranged along sole plates 102 of first article 105 and second article 107. First plate 106 of first article 105 includes a first cleat set 133 comprising a first cleat 120, a second cleat 121, a third cleat 122, a fourth cleat 123, a fifth cleat 124, and a sixth cleat 125. Second plate 108 of second article 107 includes a second cleat set 135 comprising a seventh cleat 126, an eighth cleat 127, a ninth cleat 128, a tenth cleat 129, a eleventh cleat 130, and a twelfth cleat 131. Cleats 119 may be disposed along the forefoot region of sole plates 102 in some embodiments. In other embodiments, cleats 119 may be disposed along the midfoot region of sole plates 102. In one embodiment, cleats 119 may be disposed along both the forefoot region and the midfoot region of sole plates 102. Additional cleats (not shown) may be disposed along the heel region of sole plates 102 in some embodiments. In other embodiments, sole plates 102 may not have any cleats 119.

In some embodiments, as shown in FIG. 1, sole plates 102 may include cleats 119 integrally formed with sole plates 102 through molding. In another example, sole plates 102 may be configured to receive removable cleats. In other embodiments, sole plates 102 may include cleat receiving members configured to receive removable cleat members. For example, the cleat receiving members may include threaded holes and the cleats may include threaded stems that screw into the threaded holes. In one embodiment, sole plates 102 may include both integrally formed cleats and removable cleats. In some embodiments, the cleat receiving members may be raised with respect to sole plates 102. In other embodiments, the cleat receiving members may be flush with bottom surface 116 of sole plates 102.

Cleats 119 may be made from materials known in the art for making articles of footwear. For example, cleats 119 may be made from elastomers, siloxanes, natural rubber, synthetic rubbers, aluminum, steel, natural leather, synthetic leather, plastics, or thermoplastics. In some embodiments, cleats 119 may be made of the same materials. In other embodiments, cleats 119 may be made of various materials.

For example, first cleat 120 may be made of aluminum while seventh cleat 126 may be made of a thermoplastic material. Cleats 119 and embodiments disclosed herein may also use one or more features of Auger et al., U.S. Pat. No. 7,832,117, issued Nov. 16, 2010, and titled "Article of Footwear including Full Length Composite Plate," the disclosure of which is hereby incorporated by reference in its entirety. In some embodiments, one or more methods of Auger et al. may be used to construct one or more components of cleats 119 and/or first sole structure 144.

Cleats 119 may have any type of shape. In some embodiments, cleats 119 may all have the same shape. For example, in the example embodiment shown in FIG. 1, first cleat 120 may have a similar or even identical shape to seventh cleat 126. In other embodiments, at least one of cleats 119 may have a different shape from another cleat. In some embodiments, cleats 119 may have the same height, width, and/or thickness as each other. In other embodiments, cleats 119 may have different heights, different widths, and/or different thicknesses from each other.

Cleats 119 may be arranged in any cleat pattern on the sole plates. For example, as shown in FIG. 1, first cleat 120, third cleat 122, and fifth cleat 124 may be generally aligned with one another and/or disposed adjacent to first exposed medial edge 139 of first plate 106. Similarly, in some embodiments, second cleat 121, fourth cleat 123, and sixth cleat 125 may be aligned with one another and/or disposed adjacent to first exposed lateral edge 141. Cleats 119 may be arranged in a similar manner along second plate 108, or the arrangement may differ. While the embodiments illustrated here may include the same cleat pattern (arrangement), it is understood that other cleat patterns may be used with the sole plates. The arrangement of cleats 119 may enhance traction for a wearer during cutting, turning, stopping, accelerating, and backward movement.

In addition, in different embodiments, cleats 119 of first plate 106 comprising first cleat set 133 may be similar to cleats 119 of second cleat set 135, or they may differ. For example, in some embodiments, first cleat set 133 may have a set of identically shaped cleats and/or second cleat set 135 may have a second set of identically shaped cleats. In one embodiment, first cleat set 133 may have the same height, width, and/or thickness as second cleat set 135. In another embodiment, first cleat set 133 may have a different height, width, and/or thickness from second cleat set 135. In other embodiments, first cleat set 133 may differ from second cleat set 135 in shape, number, and/or arrangement along sole plates 102. In some embodiments, first plate 106 and/or second plate 108 may not include cleats 119.

Furthermore, in different embodiments, various portions or layers of first sole structure 144 may include components other than cleats 119 that contact a playing surface and/or increase traction. In some embodiments, sole plates 102 may include traction elements that are smaller or otherwise shaped differently than cleats 119. For example, traction elements on sole plates 102 or other portions of first sole structure 144 may increase control for a wearer when maneuvering forward on a surface by engaging the surface. Additionally, traction elements may increase the wearer's stability when making lateral movements by digging into a playing surface. In other embodiments, traction elements may be molded into first sole structure 144. In some embodiments, for example, first sole structure 144 may be configured to receive removable traction elements.

As shown in FIG. 1, in some embodiments, there may be traction elements that include one or more ridges 156 or ribs 158. For example, first plate 106 includes a first ridge 157, and second plate 108 includes a second ridge 159. In addition, articles 100 include ribs 158. In FIG. 1, ribs 158 are disposed along heel member 143 of first plate 106 of first sole structure 144. For example, first article 105 includes a first rib 161, and second article 107 includes a second rib 163. In one embodiment, ridges 156 and/or ribs 158 may provide undulating or uneven portions along bottom surface 116 of first sole structure 144. In one embodiment, ridges 156 and/or ribs 158 may be recessed areas of sole structures, and in another embodiment ridges 156 and/or ribs 158 may be raised or distinct areas of sole structures. In one embodiment, traction elements may be raised, protruding, or otherwise distinct and separated portions along one or more sole structures.

In some embodiments, ribs 158 may be formed of an elastomer. As such, ribs 158 may provide further energy storage in sole plates 102 while allowing lateral flexibility. In some embodiments, first rib 161 and/or second rib 163 are contoured in such a way so as to allow additional lateral flexibility.

In different embodiments, traction elements may extend along various portions of first sole structure 144. In the embodiment of FIG. 1, ridges 156 are depicted along first midfoot region 12 and first forefoot region 10 of first plate 106. In other embodiments, ridges 156 may be disposed along first heel region 14. Furthermore, ribs 158 are depicted along first heel region 14 of first sole structure 144. First lateral side 20 and first medial side 22 of first sole structure 144 may include a different number, shape, or size of traction elements. For example, first plate 106 may include ridges 156 toward first medial side 22 that are longer relative to ridges 156 disposed along first lateral side 20. In some embodiments, ridges 156 and/or ribs 158 may differ in length from one another or they may be substantially similar.

As noted above, in different embodiments, the design and/or configuration of sole plates 102 may vary significantly according to one or more types of ground surfaces on which sole plates 102 may be used. For example, the disclosed concepts may be applicable to footwear configured for use on indoor surfaces and/or outdoor surfaces. The configuration of sole plates 102 may vary based on the properties and conditions of the surfaces on which articles 100 are anticipated to be used. For example, sole plates 102 may vary depending on whether the surface is harder or softer. In addition, sole plates 102 may be tailored for use in wet or dry conditions.

Figure 2:
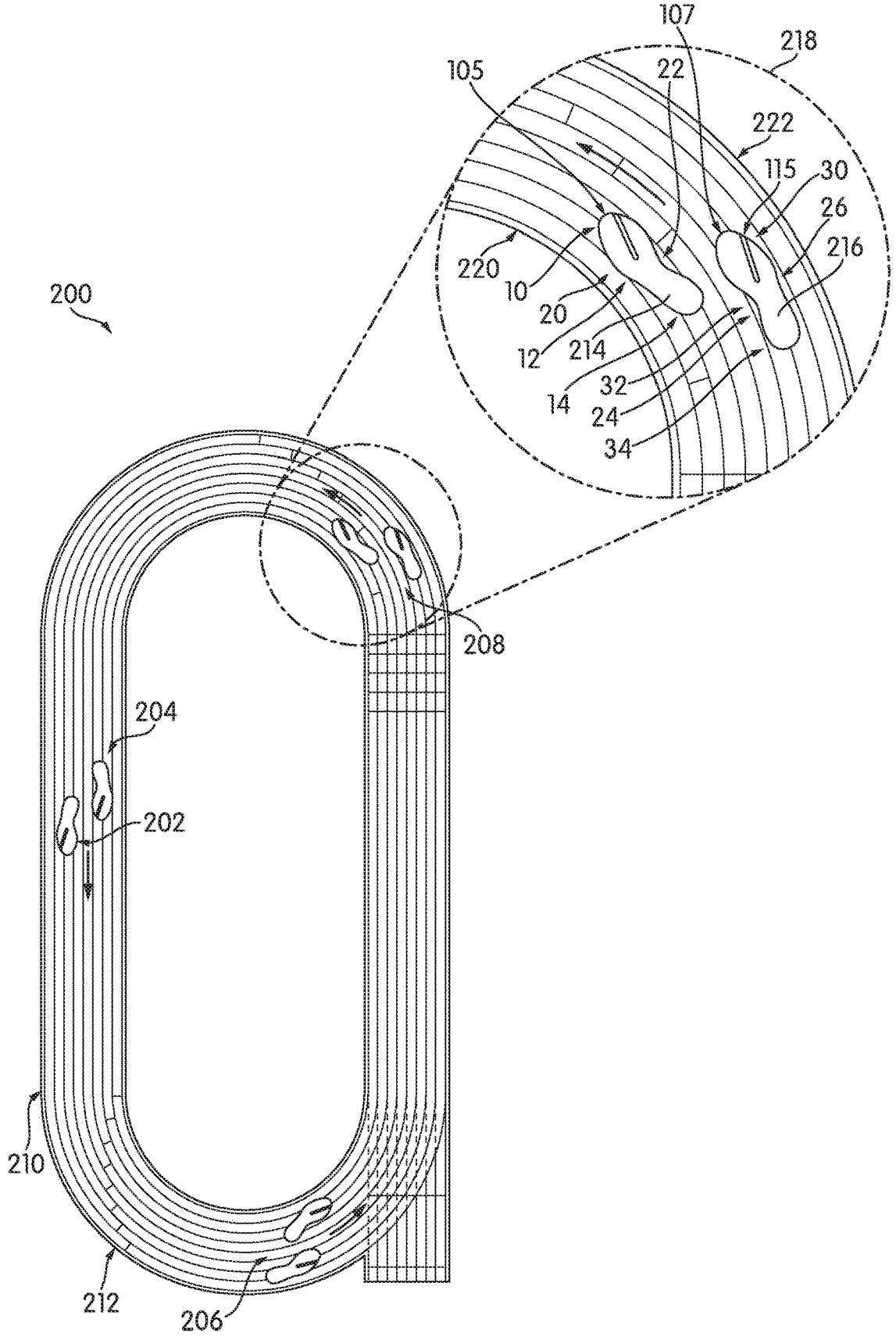
FIG. 2 is an illustration of an embodiment of a track.

Furthermore, in some embodiments, articles 100 may include sole plates 102 that differ with respect to first article 105 and second article 107. In other words, in different embodiments, the configuration of first plate 106 may vary significantly with respect to the configuration of second plate 108. For purposes of this description, "configuration" encompasses all features of sole plates 102, including shape, size, material, components, location of grooves, flexure lines, and/or traction elements, orientation, thickness, design and other features. Thus, first plate 106 may vary significantly with respect to second plate 108 according to the type of ground, surface, track type, athletic event, or other factors that affect when or where articles 100 may be used. For example, articles 100 may be worn during track events, or along a curved course. An example of a track 200 is depicted in FIG. 2. In some conventional embodiments, shoes are mirror-images of one another, including the sole structures. In other words, in some conventional embodiments, the shoes in a pair of footwear are generally symmetrical with respect to each another. However, while a pair of shoes of any type conventionally includes a right shoe that is a mirror image of the left shoe in order to provide the same functionality to corresponding portions of each foot, this may not be optimal for sports that require asymmetrical foot movement, such as track running.

For purposes of this description, the terms "symmetric configuration" and "asymmetric configuration" are used to characterize pairs of articles and/or sole plates of articles. As used herein, two sole plates have a symmetric configuration when the pair of sole plates has a symmetry about some common axis. In other words, the pair of sole plates has a symmetric configuration when one sole plate is a mirror image of the other sole plate. In contrast, two sole plates have an asymmetric configuration when there is no axis about which the sole plates have a symmetry. In other words, the pair of sole plates has an asymmetric configuration when the mirror image of one sole plate is not identical to the other sole plate.

It may be further understood that the characterizations of symmetric and asymmetric may be with reference to all features of the sole plates, or with reference to only some subset of features. In particular, given a feature of the sole plates, the sole plates may be considered as symmetric or asymmetric with respect to that feature. In the following embodiments, for example, specific consideration is given of the asymmetry of the sole plates with respect to one or more grooves in the sole plates. It should also be understood that while a pair of articles of footwear may generally include some level of asymmetry, the asymmetry described herein is primarily directed to asymmetry in the segmentation or groove formation, depth, type, number, shape, size, geometry, and/or orientation of grooves in the sole plates. Asymmetry may also be provided by variations in the stiffness or rigidity of the sole plates.

In track events that include curved paths, it can be advantageous to use a pair of articles of footwear 100 that have an asymmetrical configuration. Some tracks include curves that are built with an upward slope (or "banking") from the inner edge to the outer edge at a curve, so that asymmetric foot support conditions occur during curved running. In some cases the asymmetry is bilateral. Athletic shoes having one or more sole plates 102 adapted for sports involving asymmetric foot movements, such as track running, where each of articles 100 of the pair is designed for optimal support for each of the wearer's feet, can provide enhanced agility, performance, balance, and increase flexibility in key areas, as well as allow for a more natural stride.

For example, in FIG. 2, an outline of a pair of footwear 202 representing articles 100 is shown at various positions along track 200. It should be noted that track 200 is an example of a possible course or surface, and other tracks of varying shapes, curves, sizes, or ground type may be equivalent for purposes of this discussion. Track 200 includes an inside curve 220 and an outside curve 222.

Footwear 202 is shown at a first position 204, a second position 206, and a third position 208. Arrows illustrate the direction of travel. While first position 204 corresponds to travel over a generally straight path or a straight section 210 of track 200, second position 206 and third position 208 correspond to curved sections 212 of track 200. Third position 208 can also be seen in a magnified area 218. In FIG. 2, the direction of travel (counter-clockwise in this illustrated example) is such that what would be identified as the inner shoe with respect to the curvature of track 200 extends from first article 105 (the left shoe in this illustrated example), and the outer shoe with respect to the curvature of track 200 extends from second article 107 (the right shoe in this illustrated example). It should be noted that in other embodiments, the relationship may vary, where first article 105 may be associated with the outer shoe, and second article 107 may be associated with the inner shoe. Thus, while the discussion herein assumes first article 105 is an inner shoe 214 and second article 107 is an outer shoe 216, the configurations that are described throughout this discussion with respect to first article 105 and second article 107 may be exchanged. For example, if the direction of travel were in the opposite direction (clockwise in FIG. 2) or the track were altered, embodiments of articles 100 may be adjusted to correspond to the changes.

Figure 3:
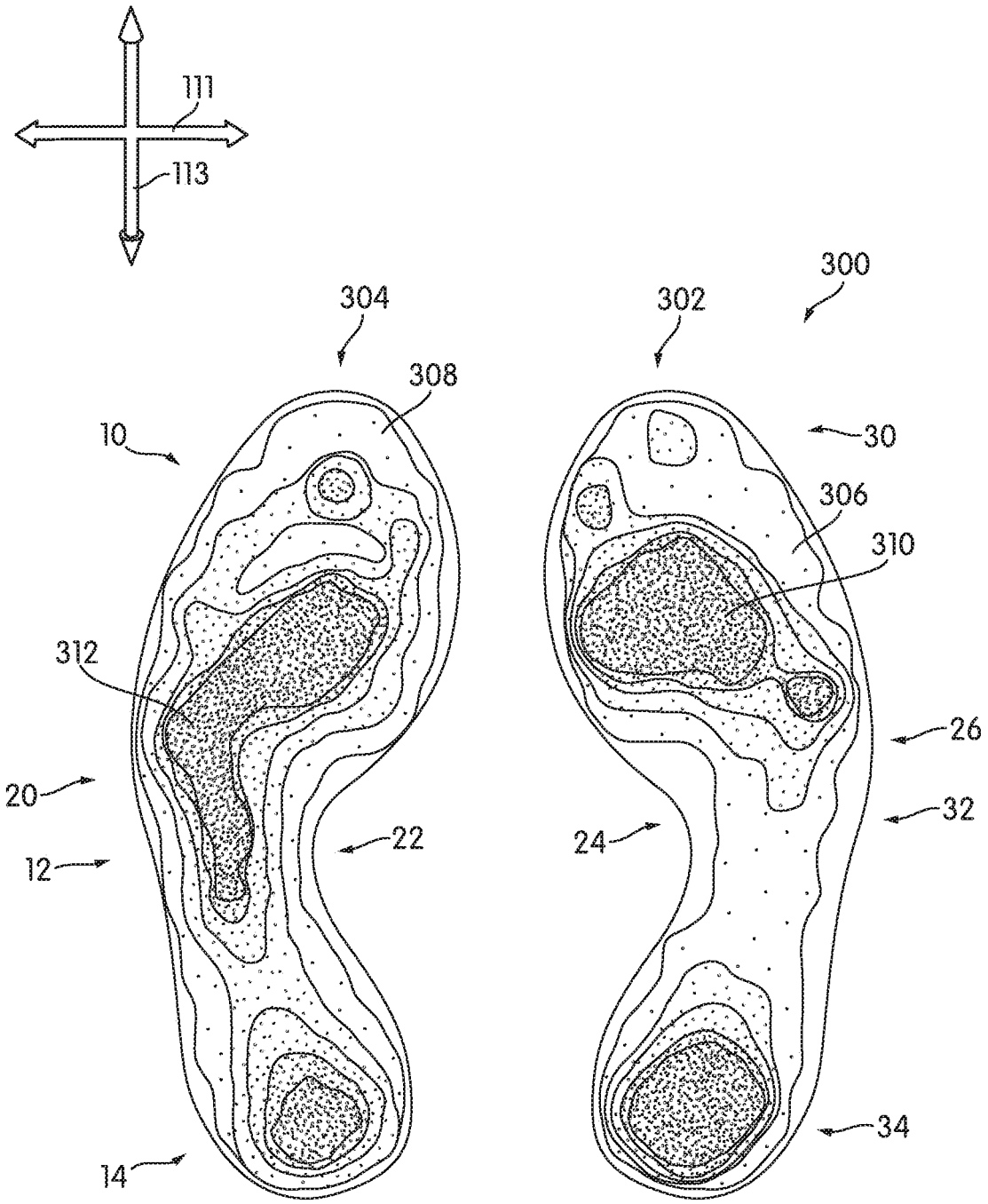
FIG. 3 is an illustration of an embodiment of plantar pressure regions.

In some embodiments, during travel over curved sections 212 of track 200, the distribution of pressure and the placement of inner shoe 214 and outer shoe 216 on track 200 can vary. In one embodiment, as a user moves over curved sections 212, as shown in magnified area 218, pressure distribution can be biased toward one side of the foot. In FIG. 3, an example of a possible pressure distribution is depicted in contoured lines. The pressure distribution can vary during running of a curved section of a track for a pair of feet 300. In FIG. 3, it can be seen that pressure distributions can be greater along first lateral side 20 of an inner foot 304 than along first medial side 22, and that the same can be true for an outer foot 302. For example, a first pressure distribution 306 on outer foot 302 is relatively similar to a second pressure distribution 308 on inner foot 304. Furthermore, a third pressure distribution 310 on outer foot 302 is similar to a fourth pressure distribution 312 on inner foot 304. However, third pressure distribution 310 is substantially greater than first pressure distribution 306, and fourth pressure distribution 312 is substantially greater than second pressure distribution 308. In other words, the pressure distribution can be asymmetrical with respect to outer foot 302 and inner foot 304 during motion over a curved track. In order to improve performance, speed, gait, etc., during running along curved tracks, articles 100 with asymmetrical flex lines, or grooves 115, can be used. As represented in FIGS. 2 and 3, in some embodiments, by forming grooves 115 in sole plates 102 that more closely correspond to the pressure distributions and/or movement of feet 300 during running over curved sections 212, there can be an increase in overall performance. For example, asymmetry in the flexure of sole plates 102 of a pair of articles 100 can allow feet 300 to roll or curl along an axis that is off-center and more closely correlated to actual use.

Figure 4:
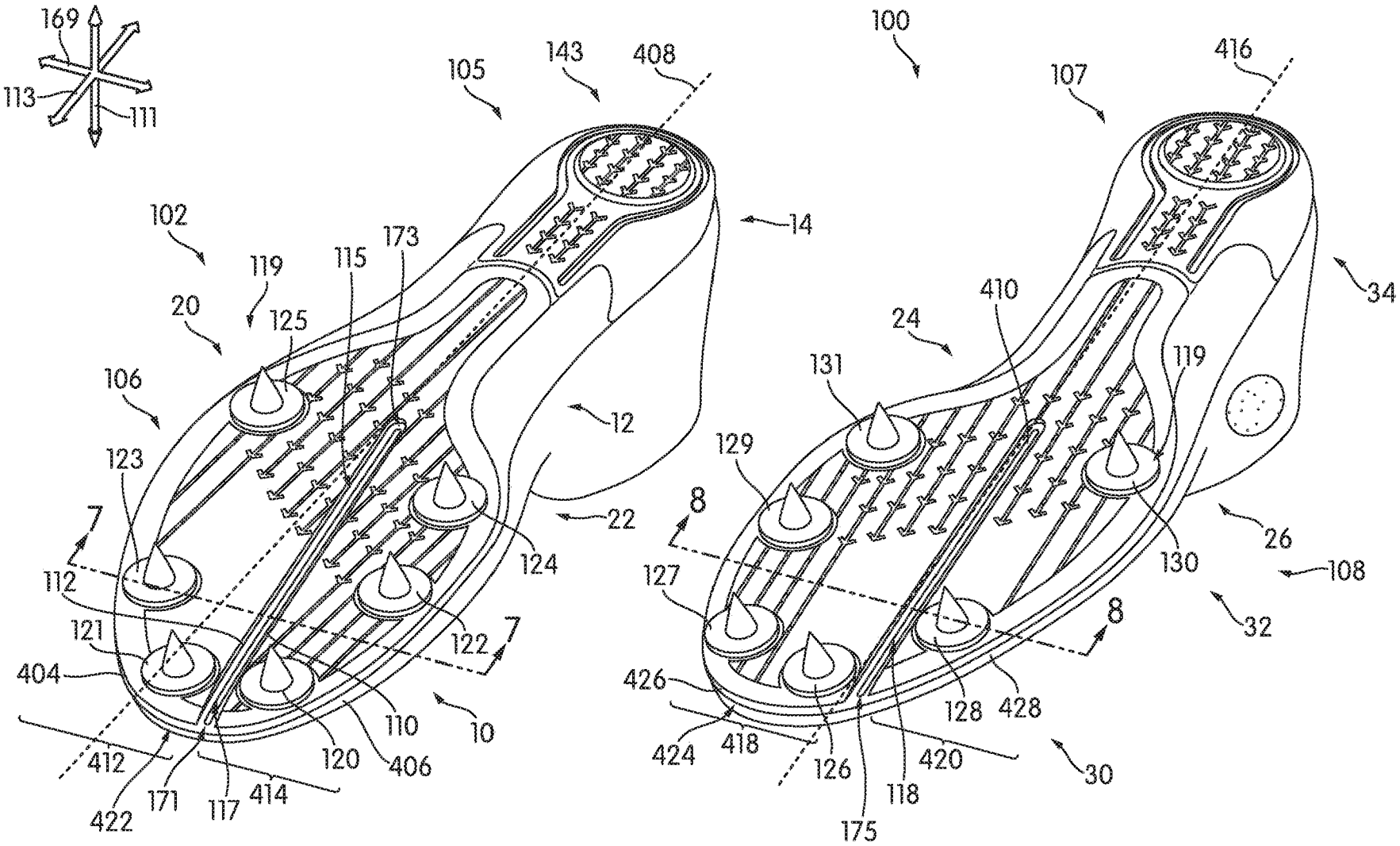
FIG. 4 is an illustration of an embodiment of a pair of sole plates.
Figure 5:
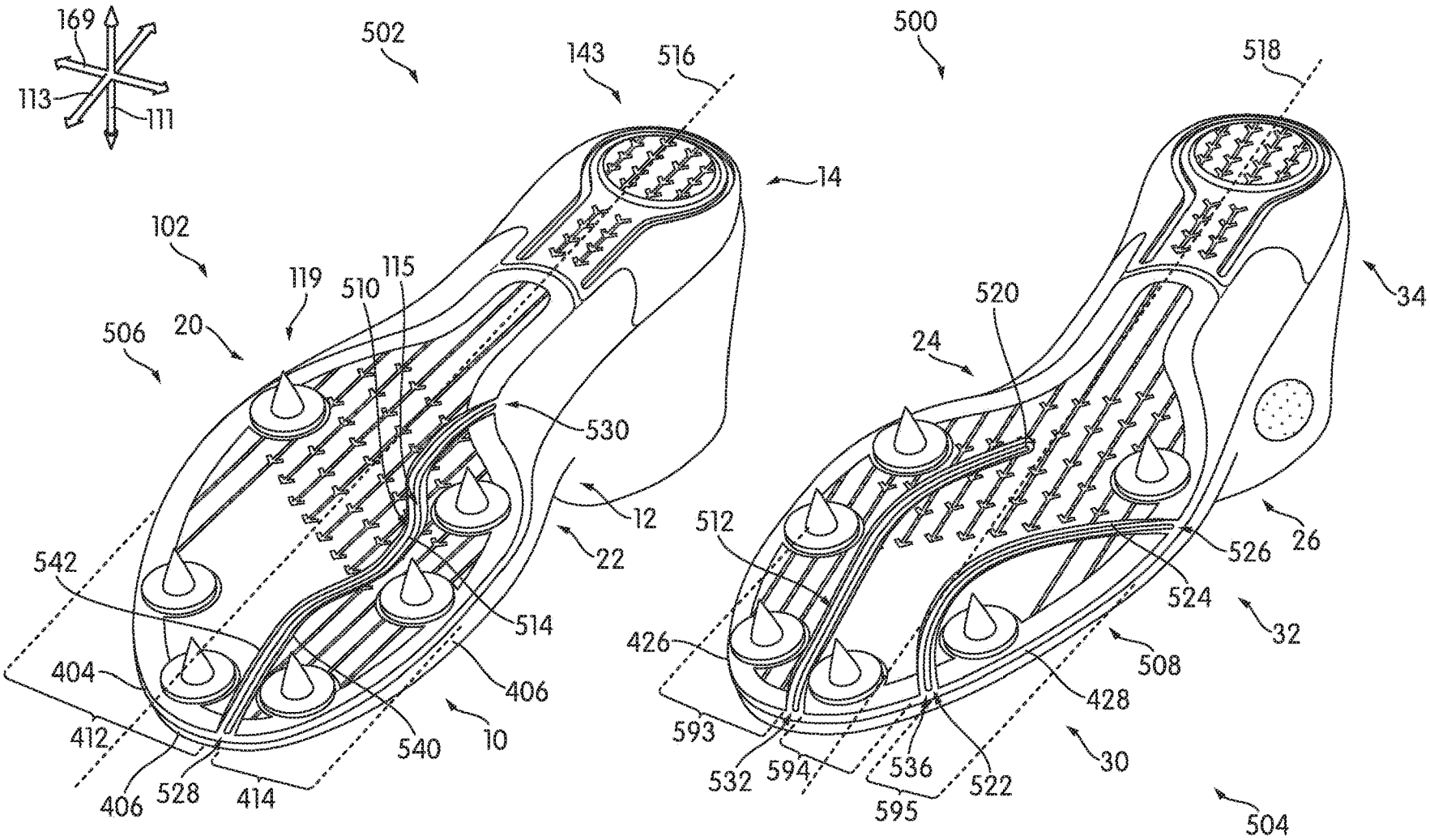
FIG. 5 is an illustration of an embodiment of a pair of sole plates.
Figure 6:
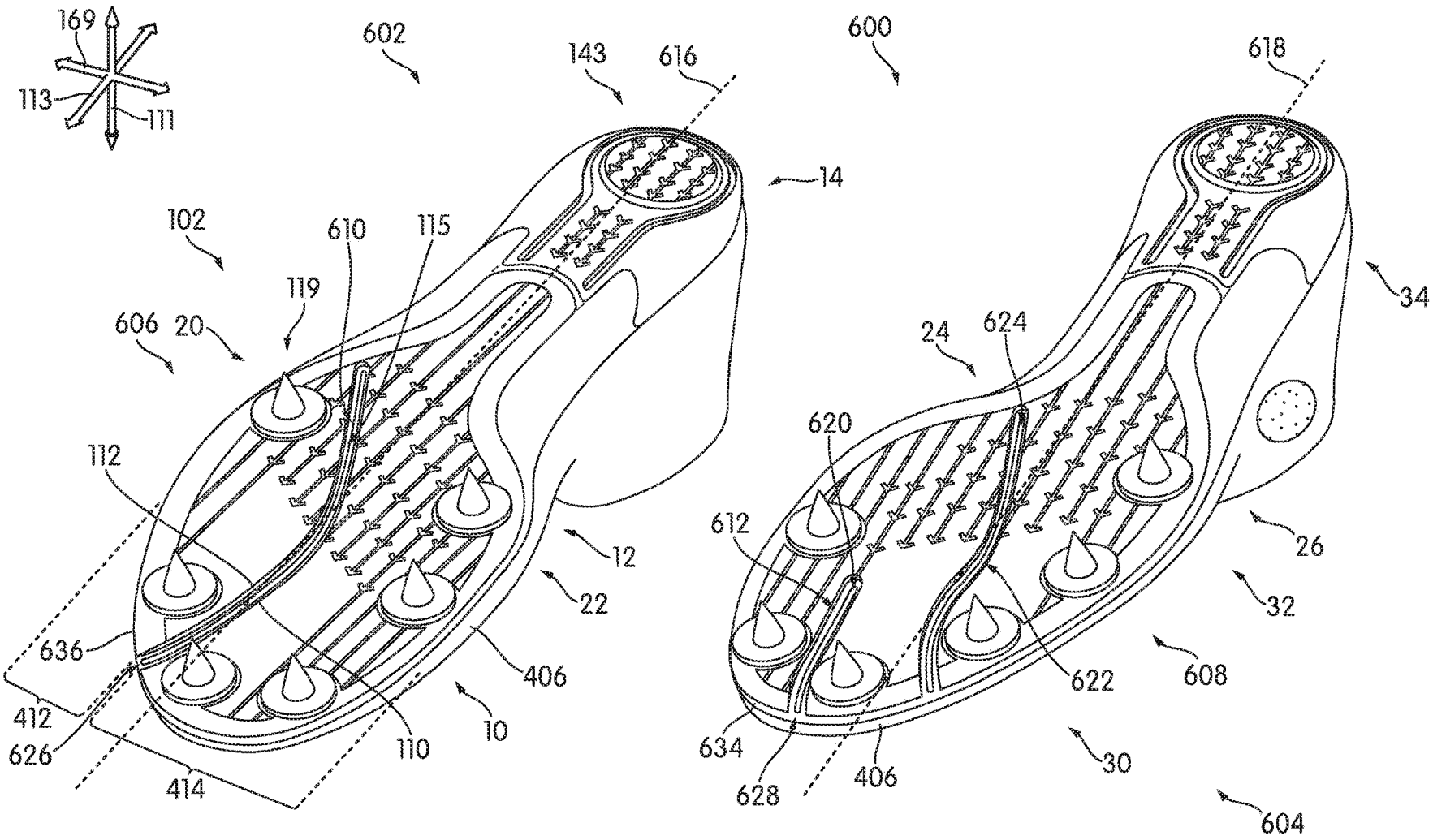
FIG. 6 is an illustration of an embodiment of a pair of sole plates.

The asymmetry can be further seen in the embodiment of FIGS. 4-6. In one embodiment, the configuration of first plate 106 can vary from that of second plate 108. In particular, in the embodiment of FIG. 4, the location of first groove 117 differs from the location of second groove 118. For example, while first groove 117 and second groove 118 are generally similar in size and shape, they have been formed along different portions of their respective sole plates 102. In other words, first groove 117 is disposed in first plate 106 such that it is asymmetrical with respect to the location of second groove 118 that is disposed in second plate 108.

In some embodiments, grooves 115 may be disposed so as to divide one or more areas of sole plates 102 into various continuous portions or regions. For purposes of this disclosure, "continuous" refers to portions of a sole plate that do not include grooves. Thus, it can be seen that in some embodiments, a groove may divide the forefoot portion or region (i.e., first forefoot region 10 and second forefoot region 30) into different continuous portions. For example, in FIG. 4, a first lateral plate portion 412 extends from the side of first plate 106 that is closer to inside curve 220 of a track, and a first medial plate portion 414 extends from the side of first plate 106 that is closer to outside curve 222 of a track (as described with reference to FIG. 2). In this case, first lateral plate portion 412 is divided from first medial plate portion 414 by first groove 117. Furthermore, first lateral plate portion 412 and first medial plate portion 414 do not in themselves include additional grooves.

It can also be seen that first lateral plate portion 412 has a maximum width that differs from the maximum width of first medial plate portion 414. Similarly, in FIG. 4, a second medial plate portion 418 extends from the side of second plate 108 that is closer to inside curve 220 of a track, and a second lateral plate portion 420 extends from the side of second plate 108 that is closer to outside curve 222 of a track, as described with reference to FIG. 2. In this case, second medial plate portion 418 is divided from second lateral plate portion 420 by second groove 118. It can be seen that second lateral plate portion 420 has a maximum width that differs from the maximum width of second medial plate portion 418. In the embodiment of FIG. 2, first lateral plate portion 412 of first plate 106 is disposed toward first lateral side 20 of first plate 106, while second medial plate portion 418 of second plate 108 is disposed toward second medial side 24 of second plate 108. In other embodiments, first lateral plate portion 412 of first plate 106 may be disposed toward first medial side 22 of first plate 106, while second medial plate portion 418 of second plate 108 may be disposed toward second lateral side 26 of second plate 108. The term "maximum width" as used herein in this context means the largest width dimension measured in the lateral direction 169 from: (a) an edge of a groove to (b) the corresponding side edge of the plate in which that groove is formed. In the example of FIGS. 1 and 4: (a) the "maximum width" of the first medial plate portion 414 is the largest width dimension measured in the lateral direction 169 from groove edge 110 to medial side edge 139 of first sole plate 106; (b) the "maximum width" of the first lateral plate portion 412 is the largest width dimension measured in the lateral direction 169 from groove edge 112 to lateral side edge 141 of first sole plate 106; (c) the "maximum width" of the second medial plate portion 418 is the largest width dimension measured in the lateral direction 169 from groove edge 179 to medial side edge 142 of second sole plate 108; and (d) the "maximum width" of the second lateral plate portion 420 is the largest width dimension measured in the lateral direction 169 from groove edge 181 to lateral side edge 145 of second sole plate 108.

As noted above, in some embodiments of this invention: (a) a maximum width of the first continuous lateral plate portion is greater than a maximum width of the second continuous lateral plate portion, and/or (b) a maximum width of the first continuous medial plate portion is less than a maximum width of the second continuous medial plate portion, thereby providing the pair of sole plates with an asymmetric configuration. As some more specific examples: (a) a maximum width of the first continuous lateral plate portion ($W_{L1}$) may be at least 5% greater (and in some examples, at least 10% greater, at least 15% greater, at least 20% greater, at least 25% greater, at least 40% greater, at least 50% greater, at least 75% greater, or even at least 100% greater) than a maximum width of the second continuous lateral plate portion ($W_{L2}$), and/or (b) a maximum width of the first continuous medial plate portion ($W_{M1}$) may be at least 5% less (and in some examples, at least 10% less, at least 15% less, at least 20% less, at least 25% less, at least 40% less, at least 50% less, or even at least 75% less) than a maximum width of the second continuous medial plate portion ($W_{M2}$). As some more specific dimensional examples: (a) $W_{L1}$ (e.g., of the lateral side of the inside curve sole plate) may be in a range of 30 mm to 115 mm (and in some examples, from 40 mm to 100 mm); (b) $W_{L2}$ (e.g., of the lateral side of the outside curve sole plate) may be in a range of 15 mm to 60 mm (and in some examples from 20 mm to 50 mm); (c) $W_{M1}$ (e.g., of the medial side of the inside curve sole plate) may be in a range of 15 mm to 60 mm (and in some examples, from 20 mm to 50 mm); and/or (d) $W_{M2}$ (e.g., of the medial side of the outside curve sole plate) may be in a range of 30 mm to 115 mm (and in some examples from 40 mm to 100 mm). With these widths, grooves, and bendability features, the complementary sole/shoe pairs in accordance with examples of this invention may leave more surface area of the complementary sole plate pair in contact with the track surface (e.g., the lateral side of the inside curve shoe 105 and the medial side of the outside curve shoe 107) as the runner leans into and runs the curve.

In some embodiments, first edge 110 and second edge 112 of first groove 117 are spaced from each other. Therefore, first edge 110 and second edge 112 may, at least partially, move relative to each other. First groove 117 may form a space that is disposed between first edge 110 and second edge 112. In other words, in one embodiment, grooves 115 may be disposed such that one or more areas of bottom surface of first upper 146 or another component of first sole structure 144 such as a midsole are exposed.

For example, in some embodiments, there may be a segment 410 of a midsole (or other sole component) that is exposed between first edge 110 and second edge 112. For instance, as shown in FIG. 4, segment 410 is exposed, allowing first lateral plate portion 412 and first medial plate portion 414 to elastically move relative to each other along first plate 106. In some cases, segment 410 may be flat relative to the surface of the bottom of the midsole. In other cases, segment may be ridged or raised in some manner. Thus, in some embodiments, first groove 117 can generally correspond to the shape of segment 410.

It should be noted that the width between first edge 110 and second edge 112 may vary across sole plates 102, and within one groove. In other words, there may be areas in longitudinal direction 113 where there is a greater area of segment 410 exposed, and areas with less exposure of segment 410. In other embodiments, the exposed area of segment 410, or the width of grooves 115, may be generally consistent from first end 171 and second end 173. In some embodiments, segment 410 may be a different size or shape between first plate 106 and second plate 108. In one embodiment, first plate 106 may include first groove 117 while second plate 108 may not include second groove 118.

As noted above, in different embodiments, grooves 115 may differ in shape, length, location, contours, and other aspects. For purposes of reference, the perimeter edge associated with first forefoot region 10 may be divided into two general areas, including a first lateral edge 404 and a first medial edge 406. First lateral edge 404 is divided from first medial edge 406 by a first center line 408 along first article 105. A second medial edge 426 is divided from a second lateral edge 428 by a second center line 416 along second article 107. First center line 408 and second center line 416 are reference lines intended to generally approximate the midline of sole plates 102 in a generally longitudinal direction 113, and are for purposes of reference only. For example, first lateral edge 404 can border the part of the forefoot perimeter corresponding more to the direction toward inside curve 220 of a track, and first medial edge 406 can border the part of the forefoot perimeter corresponding more to direction toward the outside curve 222 of a track, as described with reference to FIG. 2. In other words, first lateral edge 404 is on the side of the center line 408 that is closer to inside curve 220 when a user is traveling along a track and first medial edge 406 is on the side of the center line 408 that is closer to outside curve 222 when a user is traveling along a track (as illustrated in FIG. 2). Similarly, second medial edge 426 is on the side of the center line 416 that is closer to inside curve 220 when a user is traveling along a track and second lateral edge 428 is on the side of the center line 416 that is closer to outside curve 222 when a user is traveling along a track, as shown in FIG. 2.

It should be understood that in some embodiments, one article of footwear can have a larger medial plate portion and a smaller lateral plate portion, and the corresponding/complementary article of footwear may have a larger lateral plate portion and a smaller medial plate portion. In other words, in one embodiment, a first groove may be disposed closer to the lateral edge on one article relative to the medial edge, while a second groove may be disposed closer to the medial edge relative to the lateral edge on the other article.

In FIG. 4, first end 171 of first groove 117 begins at first forefoot region 10 along first medial edge 406, and first end 175 of second groove 118 begins at second forefoot region 30 along second lateral edge 428. Thus, both first groove 117 of first plate 106 and second groove 118 of second plate 108 are disposed to form a flex line that is located on the side of sole plates 102 disposed toward the outer curve of a track. Furthermore, it can be seen that first end 171 of first groove 117 is disposed along first medial side 22 of first plate 106, whereas first end 175 of second groove 118 is disposed along second lateral side 26 of second plate 108. In other words, an asymmetrical placement of first groove 117 and second groove 118 can be provided for the pair of sole plates 102.

In another embodiment, a groove on one plate may be asymmetrically disposed relative to the other plate. Thus, first groove 117 may be disposed toward one side of first plate 106, and second groove 118 may be disposed along or toward the opposing side of second plate 108. For example, in some cases, first groove 117 may be disposed closer to first medial side 22 than to first lateral side 20, and second groove 118 can be disposed closer to second lateral side 26 than to second medial side 24. In another case, first groove 117 can be disposed closer to first lateral side 20 than to first medial side 22, and second groove 118 may be disposed closer to second medial side 24 than to second lateral side 26.

In addition, asymmetry may be present in other ways. For purposes of reference, first plate 106 includes a first forefoot tip 422 and second plate 108 includes a second forefoot tip 424. First forefoot tip 422 extends from the most forward point of first plate 106 along longitudinal direction 113, and second forefoot tip extends from the most forward point of second plate 108 along longitudinal direction 113. It can be seen that first end 171 of first groove 117 is disposed relatively near to first forefoot tip 422. However, first end 175 of second groove 118 is disposed farther from second forefoot tip 424 than first end 171 of first groove 117 is disposed from first forefoot tip 422. As mentioned above, the inclusion of asymmetry may allow a bending of both sole plates such that there can be greater support in the areas of each sole plates 102 that are associated with an embodiment of foot pressure distributions that may occur when running along a curve of a track, as discussed with reference to FIGS. 2 and 3.

In some embodiments, cleats 119 may be included along sole plates 102. Cleats 119 may be disposed at varying locations along sole plates 102. As seen in FIG. 4, first cleat 120, third cleat 122, and fifth cleat 124 are disposed along first medial plate portion 414 of first plate 106, while second cleat 121, fourth cleat 123, and sixth cleat 125 are disposed along first lateral plate portion 412 of first plate 106. Furthermore ninth cleat 128 and eleventh cleat 130 are disposed along second lateral plate portion 420 of second plate 108, while seventh cleat 126, eighth cleat 127, tenth cleat 129, and twelfth cleat 131 are disposed along second medial plate portion 418 of second plate 108. Thus, in one embodiment, there may be asymmetry between first article 105 and second article 107 with respect to the arrangement of cleats 119 along either side of a groove. In one embodiment, for example, cleats 119 may be rearranged such that first lateral plate portion 412 has a greater number of cleats 119 than first medial plate portion 414. In another embodiment, cleats 119 may be rearranged such that first medial plate portion 414 has a greater number of cleats 119 than first lateral plate portion 412, as shown in second article 107. In some embodiments, first lateral plate portion 412 and/or first medial plate portion 414 may have no cleats 119.

In FIG. 5, a second embodiment of articles 500 are depicted. Articles 500 include a third article 502 and a fourth article 504. Third article 502 includes a third plate 506 and fourth article 504 includes a fourth plate 508. First end 528 of a third groove 510 begins at first forefoot region 10 along first medial edge 406, and first end 532 of a fourth groove 512 begins at second forefoot region 30 along second medial edge 426. Thus, it can be seen that in some embodiments, a groove may divide the forefoot regions (i.e., first forefoot region 10 and second forefoot region 30) into different portions. In addition, fourth plate 508 also includes a fifth groove 522 that begins at second forefoot region 30 along second lateral edge 428. Thus, both third groove 510 of third plate 506 and fifth groove 522 of fourth plate 508 are disposed to form a flex line that is located on the side of sole plates 102 disposed toward the outer curve of a track. This can provide an asymmetrical placement of third groove 510 and fourth groove 512 with respect to one another. As described with reference to FIG. 4, such an asymmetrical placement of third groove 510 and fourth groove 512 with respect to one another can provide a specialized bending of the pair of sole plates. In some embodiments, this bending can enhance support in the area of both sole plates that are associated with an embodiment of foot pressure distributions that may occur when running along a curve of a track (as discussed with reference to FIGS. 2 and 3).

Furthermore, as mentioned previously, in different embodiments, one sole plate may include multiple grooves 115. For example, in FIG. 5 fourth plate 508 includes two grooves 115, comprising fourth groove 512 and fifth groove 522. Thus, an additional flex line is formed along fourth plate 508. Fifth groove 522 may also extend in a generally longitudinal direction 113 along fourth plate 508. It should be noted that grooves 115 disposed along a single sole plate may be substantially different in length, width, shape, size, curvature and other aspects. For example, in the embodiment of FIG. 5, fourth groove 512 has less curvature overall than fifth groove 522. Furthermore, a second end 538 of fifth groove 522 forms an opening 526 near the perimeter of fourth plate 508, while second end 534 of fourth groove 512 remains bounded within the interior of fourth plate 508. In other embodiments, grooves 115 may be formed with various contours, paths, and in different areas of sole plates 102. In another embodiment, third plate 506 may also include additional grooves 115. In other embodiments, grooves 115 formed along a single sole plate may be substantially similar to one another.

As noted above, in some embodiments, grooves 115 may be disposed so as to divide one or more areas of sole plates 102 into various portions. For example, in FIG. 5, fourth groove 512 and fifth groove 522 may divide forefoot portion 110 of fourth plate 508 into three continuous regions, including a lateral plate portion, a medial plate portion, and an intermediate plate portion that is disposed between the lateral plate portion and the medial plate portion. In other words, there may be a second lateral plate portion 595 that extends along lateral direction 169 from second lateral side 26 to fifth groove 522, a second medial plate portion 593 that extends along lateral direction 169 from second medial side 24 to fourth groove 512, and an intermediate plate portion 594 that extends along lateral direction 169 between fourth groove 512 and fifth groove 522.

As noted above, in some embodiments, grooves 115 may have varying contours. In FIG. 5, a first contoured edge 540 and a second contoured edge 542 of third groove 510 each flow in a generally undulating or curved manner. For example, in different embodiments, the degree of curvature of either first contoured edge 540 or second contoured edge 542 of third groove 510 may differ from one another. In one embodiment, either first contoured edge 540 or second contoured edge 542 may include a curved region. In some embodiments, the degree of curvature and general shape of first contoured edge 540 can vary from that of second contoured edge 542. In some cases, the width of third groove 510 may vary along the length of third groove 510 in longitudinal direction 113. In another embodiment, the degree of curvature of either first contoured edge 540 or second contoured edge 542 may be substantially similar, whereby first contoured edge 540 has a curve and/or shape equivalent to second contoured edge 542. In these cases, third groove 510 may include generally contoured lines or edges extending from first end 528 to a second end 530. In other cases, the contoured edges may have corresponding shapes along some portions of grooves 115, but be non-parallel along other portions. As used herein, two non-straight contours of a groove may be said to be "parallel" if they are congruent in the geometric sense and have a constant spacing along the length of the groove.

As discussed previously, the shapes of grooves 115 may differ between third plate 506 and fourth plate 508, forming asymmetrical flex lines along sole plates 102. In the embodiment of FIG. 5, a third center line 516 along third article 502 and a fourth center line 518 along fourth article 504 are depicted. Third center line 516 and fourth center line 518 are reference lines intended to generally approximate the mid-line of sole plates 102 in a generally longitudinal direction 113, and are for purposes of reference only. In some embodiments, third groove 510 may be located on the side of third center line 516 corresponding more to the direction toward outside curve 222 of a track (as seen in FIG. 2). As illustrated in FIG. 5, in one embodiment, fourth groove 512 may be located on the side of fourth center line 518 corresponding more to the direction toward inside curve 220 of a track (as seen in FIG. 2). In one embodiment, fifth groove 522 may be located on the side of fourth center line 518 corresponding more to the direction toward outside curve 222 of a track (as seen in FIG. 2). In another embodiment, asymmetry may be formed along the opposite side or direction of sole plates 102. In other embodiments, grooves 115 may be disposed along either the side of the sole plate corresponding to inside curve 220 or outside curve 222, and/or grooves 115 may be disposed such that they extend along both the lateral side and the medial side of sole plates 102.

In some embodiments, first contoured edge 540 and/or second contoured edge 542 defining the boundary of third groove 510 can curve or otherwise create exposed areas along third plate 506. For example, in FIG. 5, third groove 510 in third article 502 forms a first exposed portion 514, and in fourth article 504, fourth groove 512 forms a second exposed portion 520. The shape, size, and/or depth of an exposed portion may differ between sole plates 102 or may be substantially similar.

In FIG. 6, a third embodiment of articles 600 are depicted. Articles 600 include a fifth article 602 and a sixth article 604. Fifth article 602 includes a fifth plate 606 and sixth article 604 includes a sixth plate 608. A first end 626 of a sixth groove 610 along fifth plate 606 begins at first forefoot region 10 along a first lateral edge 636, and a first end 628 of a seventh groove 612 along sixth plate 608 begins at second forefoot region 30 along a second medial edge 634. Thus, in one embodiment, both sixth groove 610 of fifth plate 606 and seventh groove 612 of sixth plate 608 can be disposed to form a flex line that is located on the side of the sole plates disposed toward the inside curve 220 of a track (see FIG. 2), forming an asymmetrical arrangement in the pair of sole plates. The asymmetrical placement of sixth groove 610 and seventh groove 612 with respect to one another can provide support in various regions of sole plates 102 that are associated with an embodiment of foot pressure distributions that may occur when running along a curve of a track, as described with reference to FIGS. 2 and 3.

In addition, as described earlier, in different embodiments, sole plates 102 may include multiple grooves 115. For example, in FIG. 6 sixth plate 608 includes an eighth groove 622. Eighth groove 622 may also extend in a generally longitudinal direction 113 along sixth plate 608. It should be noted that grooves 115 disposed along a single sole plate may be substantially different in length, width, shape, size, curvature and other aspects. In other embodiments, grooves 115 along a single sole plate may be substantially similar. For example, in the embodiment of FIG. 6, seventh groove 612 has less curvature than eighth groove 622 (and, as shown, the seventh groove 612 may be substantially linear). In addition, the length of seventh groove 612 is smaller in length (along longitudinal direction 113) than the length of eighth groove 622. Furthermore, a second end 624 of eighth groove 622 and a second end 620 of seventh groove 612 both remain within the interior of sixth plate 608 and do not form an opening near the perimeter. In other embodiments, grooves 115 may be formed with various contours, paths, and along different areas of sole plates 102. In another embodiment, fifth plate 606 may also include additional grooves 115. In one embodiment, sixth plate 608 may have three or more grooves 115.

As described earlier, in some embodiments, cleats 119 may be disposed along articles 600 in such a manner as to also form asymmetry between sole plates of fifth article 602 and sixth article 604. For example, in the embodiment of FIG. 6, cleats 119 may be arranged in different configurations between fifth plate 606 and sixth plate 608. Along fifth plate 606, cleats 119 are disposed similar to the embodiment of FIG. 5, where there are three cleats 119 along first medial side 22 and three cleats along first lateral side 20, generally. However, along sixth plate 608, cleats 119 are arranged such that there are a greater number of cleats 119 toward second lateral side 26 and fewer cleats 119 along second medial side 24. Furthermore, in some embodiments, cleats 119 may be rearranged or disposed to allow grooves 115 to be disposed along any portion of sole plates 102. In one embodiment, cleats 119 may be shifted or formed along different areas or portions of sole plates 102. In other embodiments, cleats 119 may be symmetrical between fifth article 602 and sixth article 604.

Figure 7:
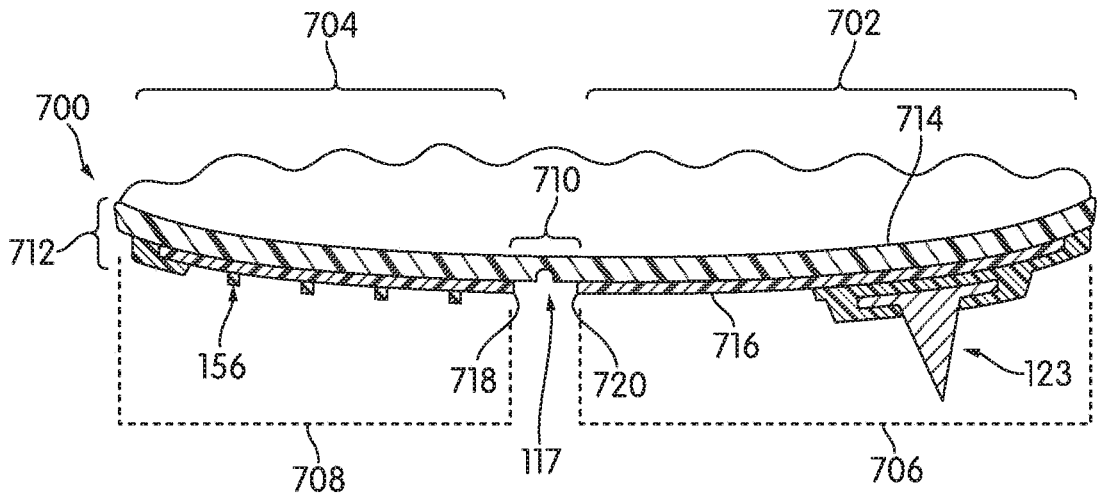
FIG. 7 is a cross-sectional view of an embodiment of the sole plate for the first article of FIG. 4.
Figure 8:
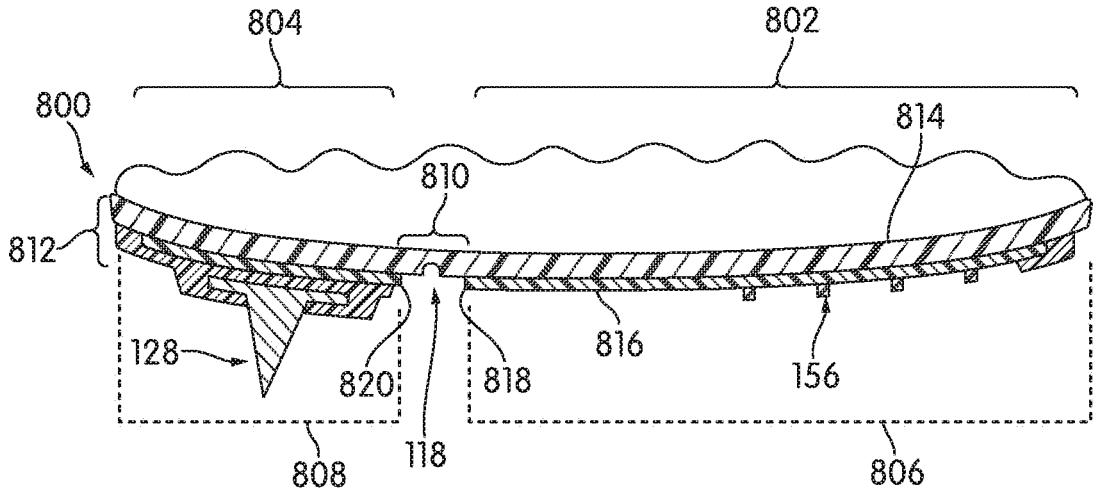
FIG. 8 is a cross-sectional view of an embodiment of the sole plate for the second article of FIG. 4.

In the embodiments of FIGS. 7 and 8, a cross-sectional view of a portion of first plate 700 for first article 105 is illustrated along the line labeled 7-7 (see FIG. 4) and a cross-sectional view of a portion of second plate 800 for second article 107 along the line labeled 8-8 (see FIG. 4) is illustrated. In FIG. 7, a portion of first plate 700 is shown with first groove 117 dividing this portion of first plate 700 into two regions, including a lateral plate portion 702 and a medial plate portion 704. Lateral plate portion 702 may correspond with a first lateral length 706, and medial plate portion 704 may correspond with a first medial length 708. This illustrated portion of first plate 700 may additionally have a first thickness 712 corresponding to the width between a top surface 714 of the first plate and a bottom surface 716 of the first plate. First groove 117 may also include a first width 710 that extends from the distance between a first contoured edge 718 and a second contoured edge 720.

In FIG. 8, a portion of second plate 800 is shown with second groove 118 dividing this portion of second plate 800 into two regions, including a medial plate portion 802 and a lateral plate portion 804. Medial plate portion 802 may correspond with a second medial length 806, and lateral plate portion 804 may correspond with a second lateral length 808. This illustrated portion of second plate 800 may additionally have a second thickness 812 corresponding to the width between a top surface 814 of the first plate and a bottom surface 816 of the first plate. Second groove 118 may also include a second width 810 that extends from the distance between a first contoured edge 818 and a second contoured edge 820.

Depending on the locations of first groove 117 and second groove 118, in different embodiments, first lateral length 706 may be equal to or vary from second medial length 806 and/or second lateral length 808. Similarly, first medial length 708 may be equal to or vary from second medial length 806 and/or second lateral length 808. The lengths of each portion in lateral direction 169 may be configured for user preferences, individual foot pressure distribution, track characteristics, performance enhancement, and other factors.

In addition, the width of a groove may vary between a first article and a second article. In FIGS. 7 and 8, first width 710 and second width 810 are substantially similar. However, in other embodiments, first width 710 may be greater or smaller than second width 810. Similarly, the thickness of sole plates 102 may differ between a first article and a second article. In FIGS. 7 and 8, first thickness 712 and second thickness 812 are substantially similar. However, in other embodiments, first thickness 712 may be greater or smaller than second thickness 812. Each of these characteristics may be adjusted to enhance performance and/or provide additional asymmetry between first plate 106 and second plate 108. It should be noted that thickness, length, width, and other dimensions of sole plates 102 may also vary along different portions of sole plates 102.

Figure 9:
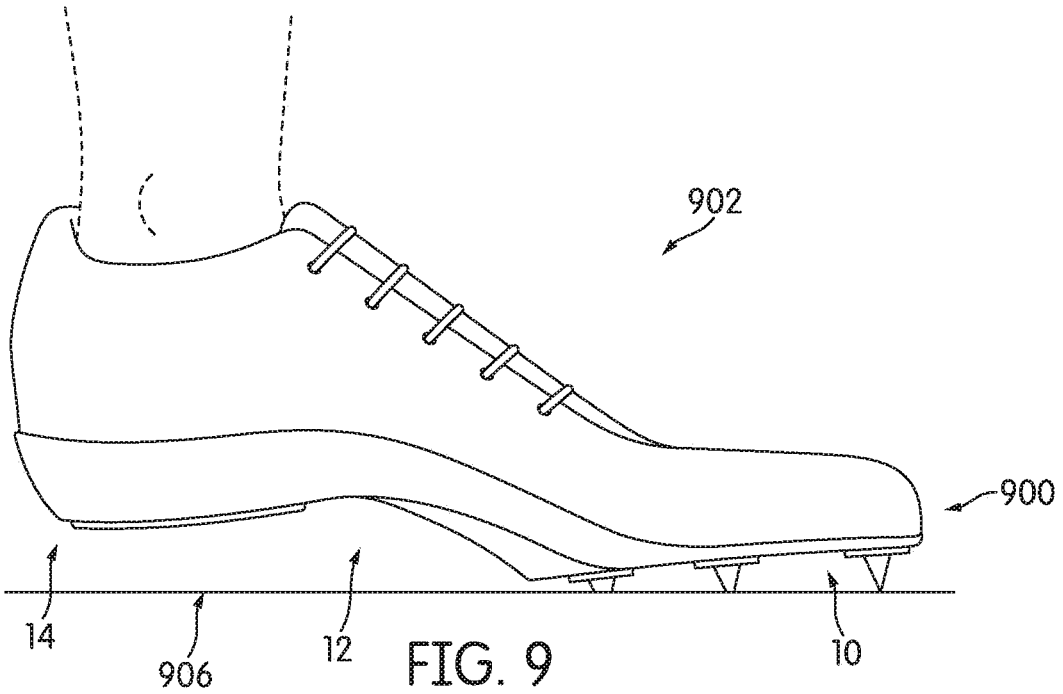
FIG. 9 is a side view of an embodiment of the first article of FIG. 4 at rest.
Figure 10:
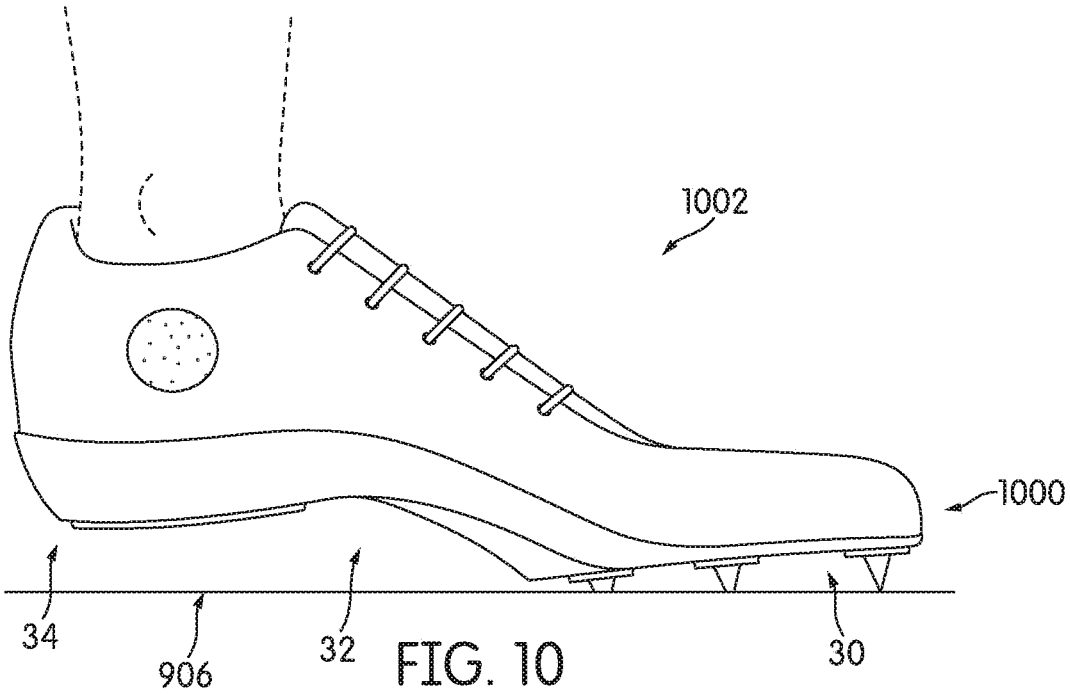
FIG. 10 is a side view of an embodiment of the second article of FIG. 4 at rest.

FIGS. 9-16 illustrate an embodiment of a pair of articles of footwear during operation. Specifically, FIGS. 9-16 illustrate various configurations of articles undergoing bending due to the features of sole plates 102 described above. In some embodiments, articles may vary in stiffness to provide the pair of articles with asymmetrical stiffness (e.g., Young's modulus). For example, as shown in FIGS. 9-12, the stiffness or rigidity of an embodiment of a first plate 900 may vary from the stiffness or rigidity of an embodiment of a second plate 1000. As shown in FIGS. 9 and 10, first plate 900 is included in a first article 902, and second plate 1000 is included in a second article 1002. In FIGS. 9 and 10, first article 902 and second article 1002 are shown generally at rest on a substantially level track surface 906. In one embodiment, sole plates 102 may include no grooves 115, and be asymmetrical with respect to one another due to differences in the degree of stiffness or rigidity of sole plates 102. As some more specific examples, the one plate of a complementary pair of sole plates may have a stiffness that is at least 10% greater than a stiffness of the other plate of the complementary pair (and in some examples, the stiffness differential may be at least 20% greater, at least 25% greater, at least 40% greater, or even at least 50% greater). Stiffness may be measured using any known or desired technique or equipment, e.g., such as via a 3-point bending measurement method as is conventionally known.

Figure 11:
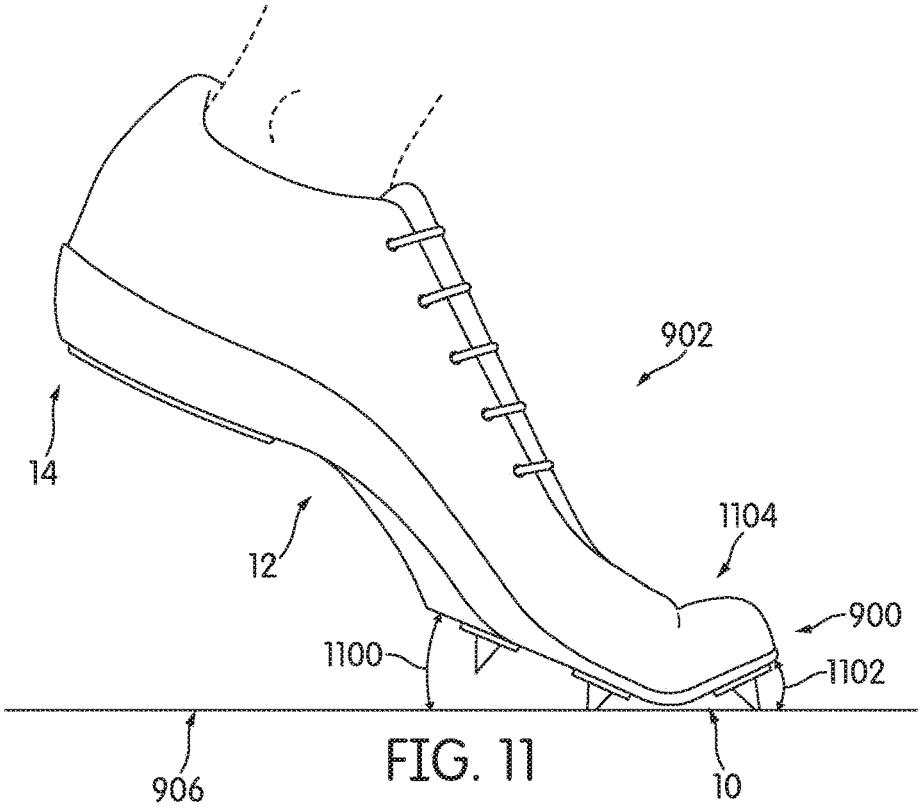
FIG. 11 is a side view of an embodiment of the first article of FIG. 4 during flexing.
Figure 12:
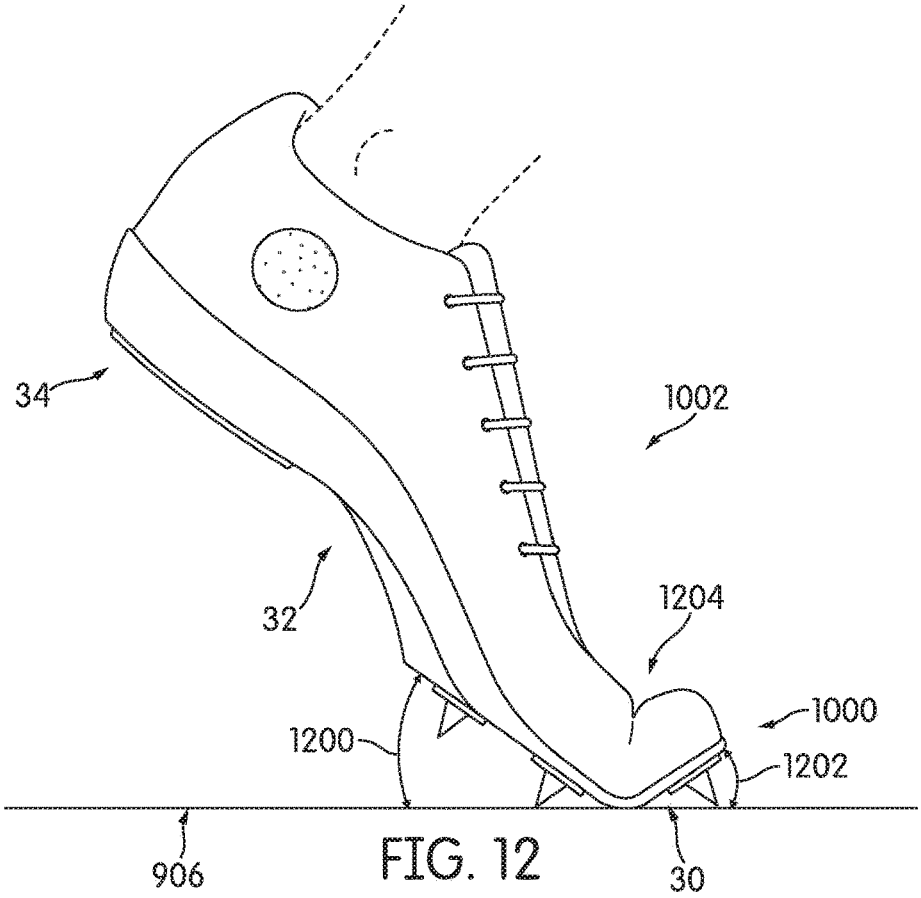
FIG. 12 is a side view of an embodiment of the second article of FIG. 4 during flexing.

In FIGS. 11 and 12, first article 902 and second article 1002 are shown undergoing substantially similar bending forces as they move along track surface 906. In FIG. 11, first article 902 is experiencing bending along a first region of bending 1104 within first forefoot region 10. Similarly, in FIG. 12, second article 1002 is generally experiencing bending along a second region of bending 1204 within second forefoot region 30. In some embodiments, the degree of bending occurring in either first plate 900 or second plate 1000 may differ significantly although undergoing substantially similar bending forces. As seen in FIG. 11, first plate 900 has been bent so that the portion of first plate 900 corresponding to first midfoot region 12 and first heel region 14 have risen to form a first angle 1100, and the portion of first plate 900 corresponding to first forefoot region 10 has risen to form a second angle 1102. In FIG. 12, second plate 1000 has been bent to a greater extent than that of first plate 900 in FIG. 11, such that the portion of second plate 1000 corresponding to second midfoot region 32 and second heel region 34 have risen to form a third angle 1200, and the portion of second plate 1000 corresponding to second forefoot region 30 has risen to form a fourth angle 1202. In the embodiments of FIGS. 11 and 12, first angle 1100 is less than third angle 1200, and second angle 1102 is less than fourth angle 1202. In other words, when exposed to similar bending forces, first plate 900 bends less than second plate 1000. Thus, in some embodiments, first plate 900 can include a greater degree of rigidity than second plate 1000. In other embodiments, first plate 900 can have a lesser degree of rigidity than second plate 1000. In other embodiments, the stiffness of first plate 900 may be substantially similar to that of second plate 1000.

It should be noted that first plate 900 may furthermore include variations in stiffness or rigidity within first plate 900, and second plate 1000 may also include variations in stiffness or rigidity throughout second plate 1000, or the stiffness across first plate 900 and/or second plate 1000 may be substantially similar. In some applications it is desirable to have different flexibilities in different regions of an article. Such varying zones of flexibility may allow, for example, the article to be further customized to balance a user's comfort during operation. For instance, a point of impact of first plate 900 onto a playing surface may frequently occur in first forefoot region 10 and rarely occur in the first midfoot region 12. Accordingly, first forefoot region 10 may be configured to have a lower rigidity than first midfoot region 12 to allow for improved user's comfort during operation.

Similarly, first midfoot region 12 may be configured to have a higher rigidity than first forefoot region 10 to allow for a higher energy return. In some embodiments, first plate 900 may be provided with a degree of rigidity that is asymmetric with respect to the degree of rigidity of second plate 1000.

Stiffness along one sole plate may be varied by increasing the thickness of one or more regions of the plate relative to other regions. For example, a lateral plate portion can be thicker than the corresponding medial plate portion along the same plate. In addition, the inclusion of a greater number of grooves along a first region of the sole plate relative to a second region of the same sole plate can decrease the stiffness of the first region compared to the second region. The depth of a groove (i.e., the extent with which the groove extends through the thickness of a sole plate) may also be varied to change the stiffness in one region of a sole plate versus another region.

Thus, in different embodiments, stiffness may be varied across a single sole plate. For example, first plate 900 may include a stiffer first lateral plate portion relative to the first medial plate portion, or the first medial plate portion may include a greater stiffness than the first lateral plate portion. Similarly, second plate 1000 may include a stiffer second lateral plate portion relative to the second medial plate portion, or the second medial plate portion may include a greater stiffness than the second lateral plate portion.

In different embodiments, the rigidity of a sole plate may be also varied by the inclusion of different materials or structures. For example, the sole plates may include one or more materials, including but not limited to carbon fiber, carbon fiber composite, nylon/glass composite, Kevlar fibers, rubber, foam rubber, polyester, synthetic rubber, polymeric material, and/or composite material(s) or fibers with greater or lesser elasticity. Furthermore, structures such as gel packs, air bladders, embedded structures such as a frame, or other structures may be used to vary the rigidity.

Figure 13:
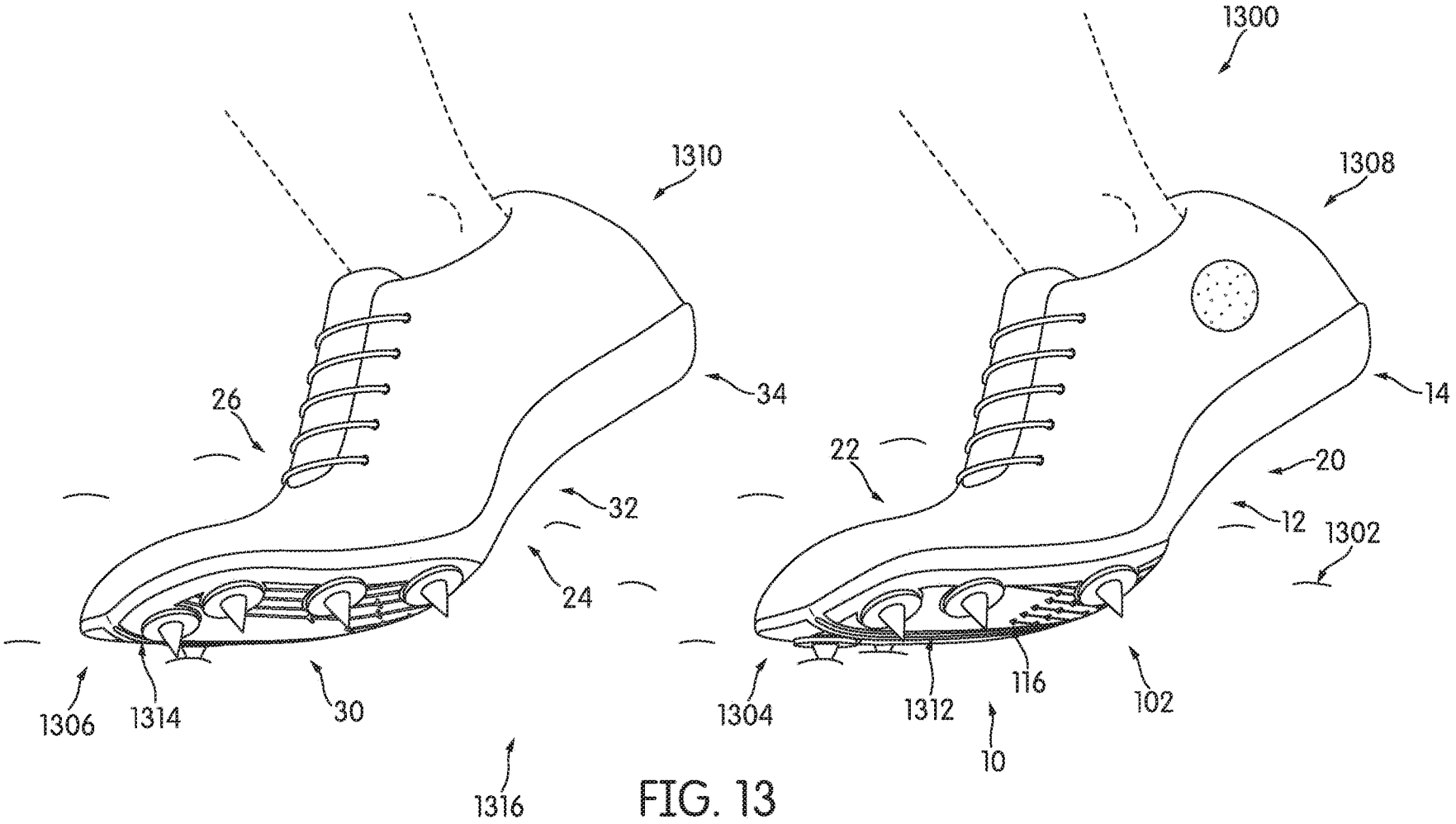
FIG. 13 is an isometric view of an embodiment of the articles of FIG. 4 after a flexing of the sole plates.
Figure 14:
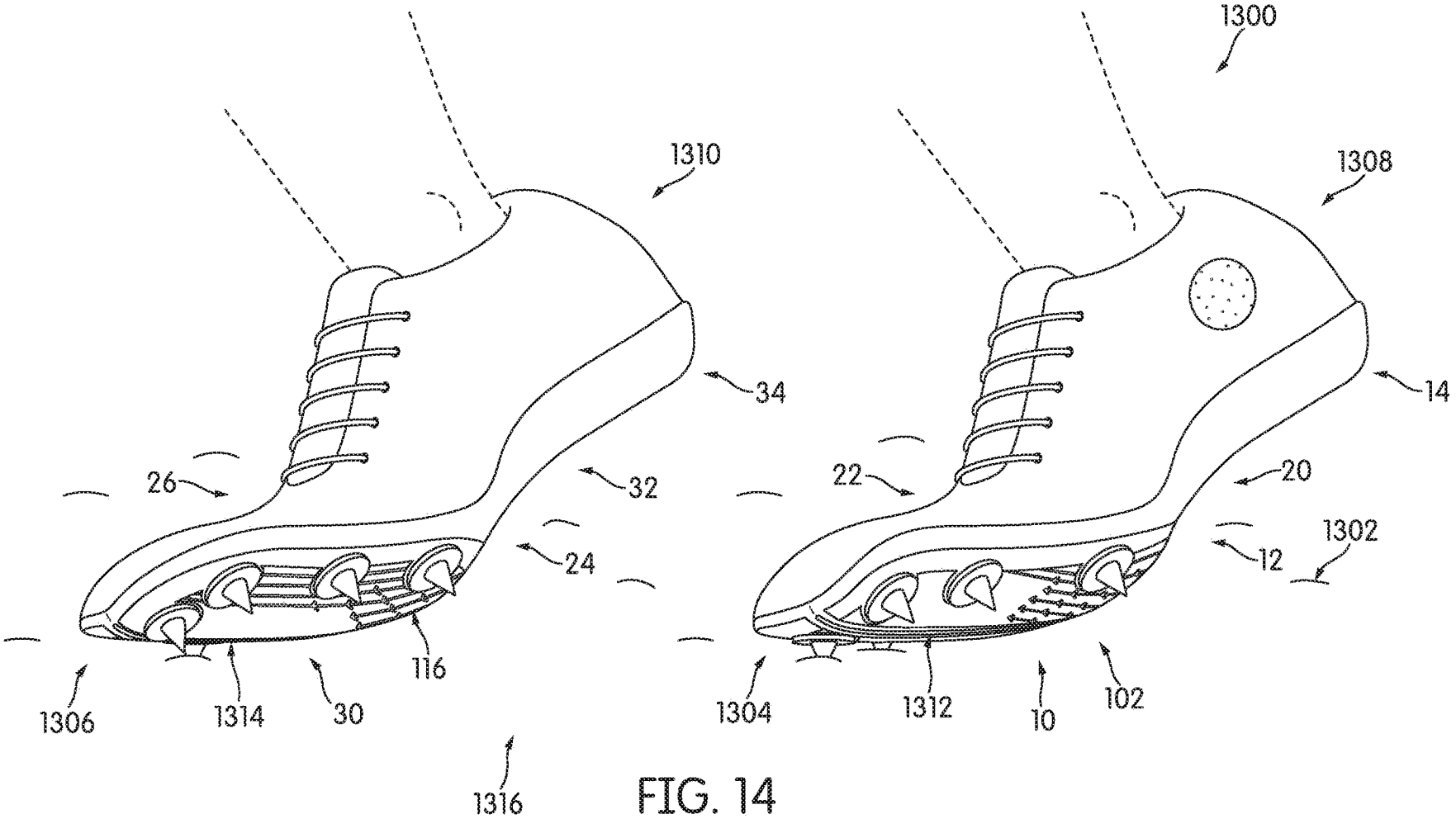
FIG. 14 is an isometric view of an embodiment of the articles of FIG. 4 after a flexing of the sole plates.

As discussed earlier, bending of articles may also result from inclusion of grooves in the sole plates. In FIGS. 13-16, a user 1300 contacts bottom surface 116 of sole plates 102 to a running surface 1302 while wearing articles 1316. As shown, bottom surface 116 impacts running surface 1302 along first forefoot region 10 of first medial side 22 of a first plate 1304 corresponding to a first article 1308. Similarly, bottom surface 116 of a second plate 1306 impacts running surface 1302 along second forefoot region 30 of second lateral side 26 corresponding to a second article 1310. As illustrated in FIGS. 13-14, due to the impact, sole plates 102 may begin to flex along a first groove 1312 of first plate 1304 and a second groove 1314 of second plate 1306. In FIG. 14, as a greater force is exerted by user 1300, each sole plate bends further along first groove 1312 and second groove 1314. This asymmetrical flexing between first article 1308 and second article 1310 may provide a more natural feel to user 1300, as articles 1316 allow the user to bend first article 1308 (corresponding to inner foot 304) and second article 1210 (corresponding to outer foot 302) in a way that more closely reflects the curvature of a track, as discussed with reference to FIGS. 2 and 3.

Figure 15:
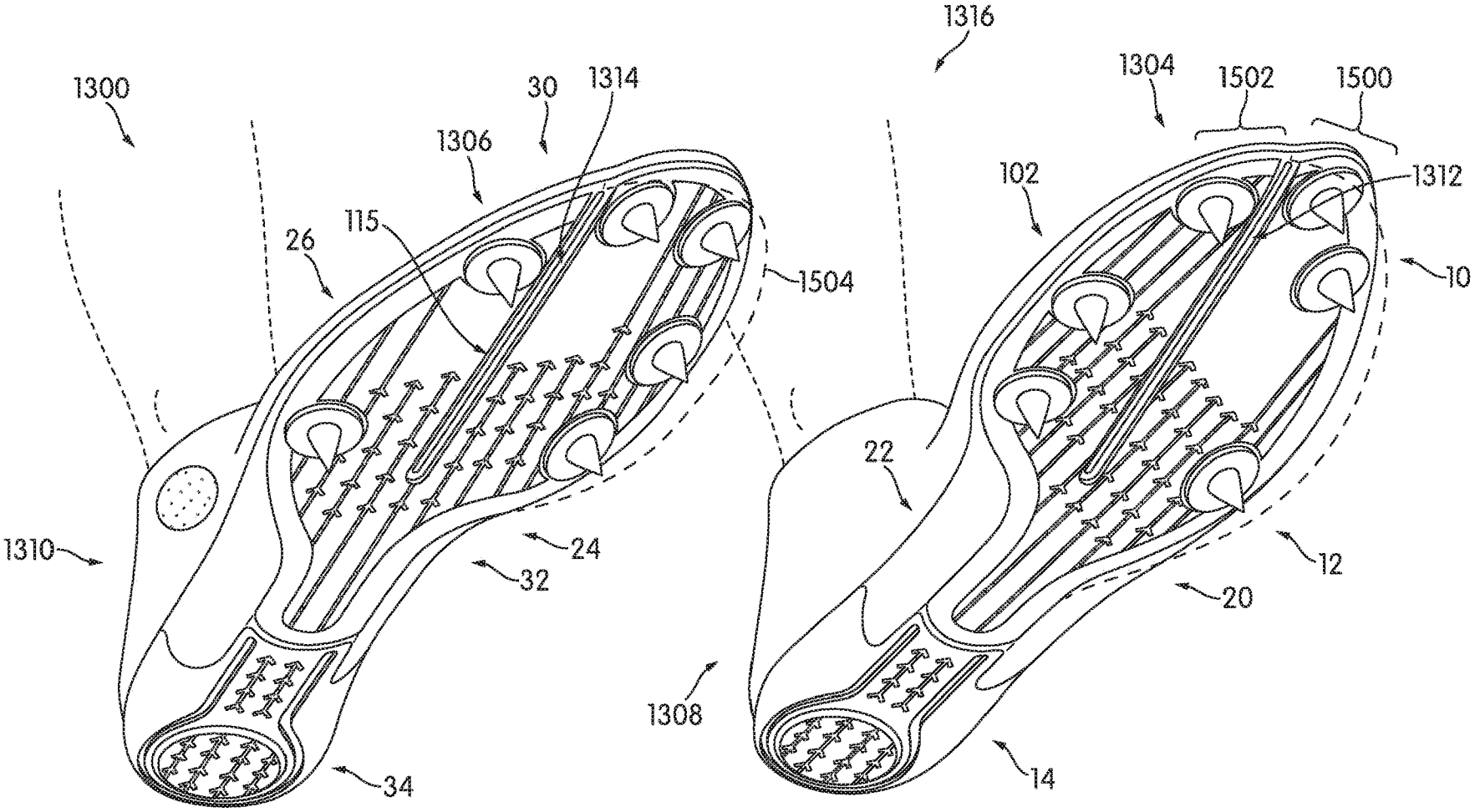
FIG. 15 is a bottom isometric view of an embodiment of the articles of FIG. 4 after a flexing of the sole plates.
Figure 16:
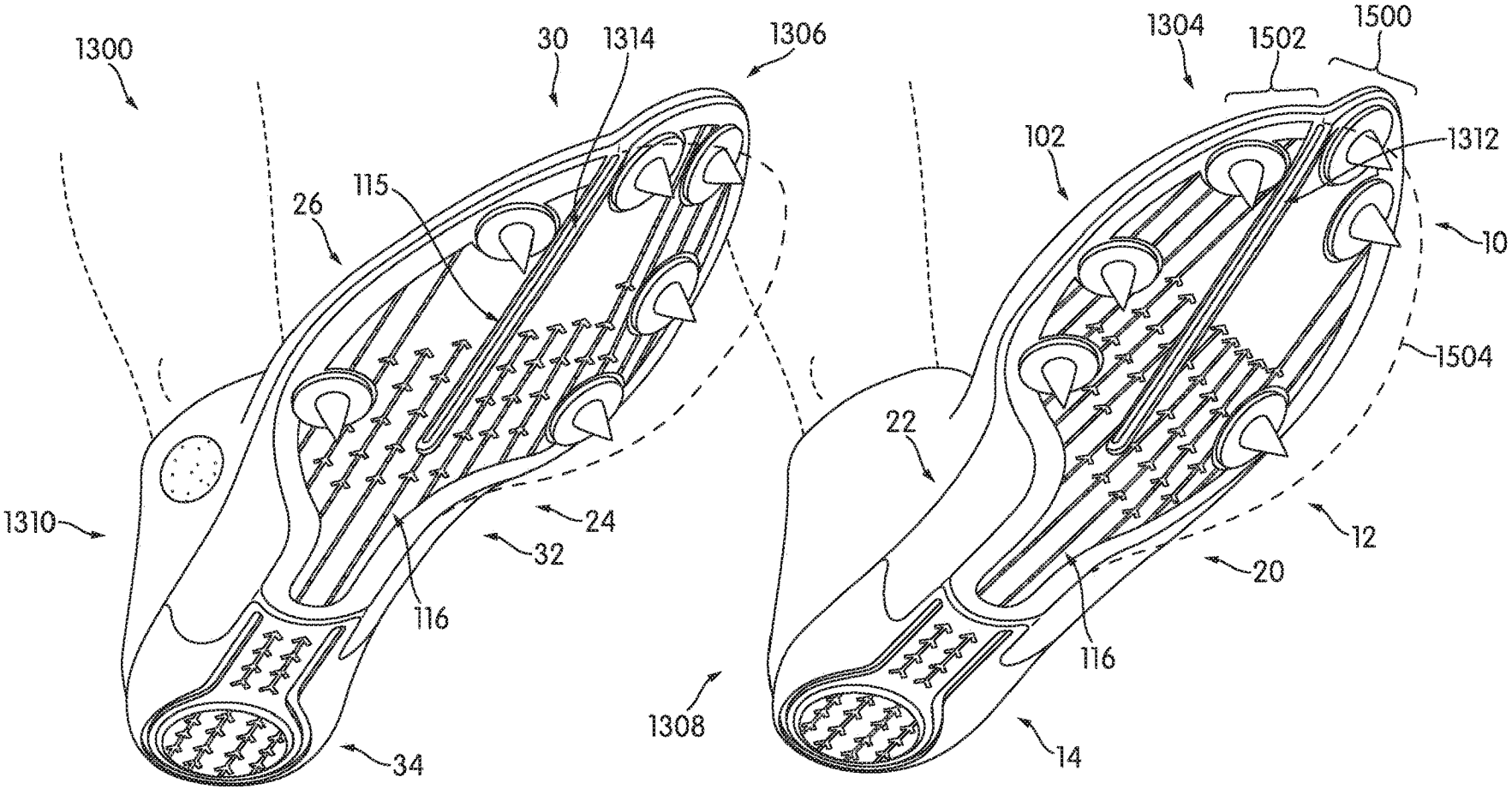
FIG. 16 is a bottom isometric view of an embodiment of the articles of FIG. 4 after a flexing of the sole plates.

In other words, as shown in the bottom-side views illustrated in FIGS. 15 and 16, the impact upon running surface 1302 may allow sole plates 102 to flex along first groove 1312 and second groove 1314. This flexing may provide a natural running experience to user 1300, as article 1316 allows user 1300 to more effectively accommodate the curves of a track. In FIG. 15, first plate 1304 and second plate 1306 are both beginning to be bent along grooves 115 in a similar manner as articles 1316 impact the running surface (not shown). The dotted lines 1504 indicate the position of sole plates 102 when articles are generally at rest along running surface 1302. In FIG. 16, as user 1300 applies increased asymmetric pressure in articles 1316 along the running surface (not shown), the bending increases along grooves 115. In the embodiments of FIGS. 15 and 16, first groove 1312 and second groove 1314 are disposed to favor bending such that a lateral plate portion 1500 may maintain contact with running surface 1302 while a medial plate portion 1502 may bend further upward. The asymmetrical placement of grooves 115 allows flexing to occur where it may enhance user 1300 performance, balance, agility, and facilitate a quicker response time. In other embodiments, the asymmetry may be adjusted to provide flexing in various areas of each of sole plates 102.

Figure 17:
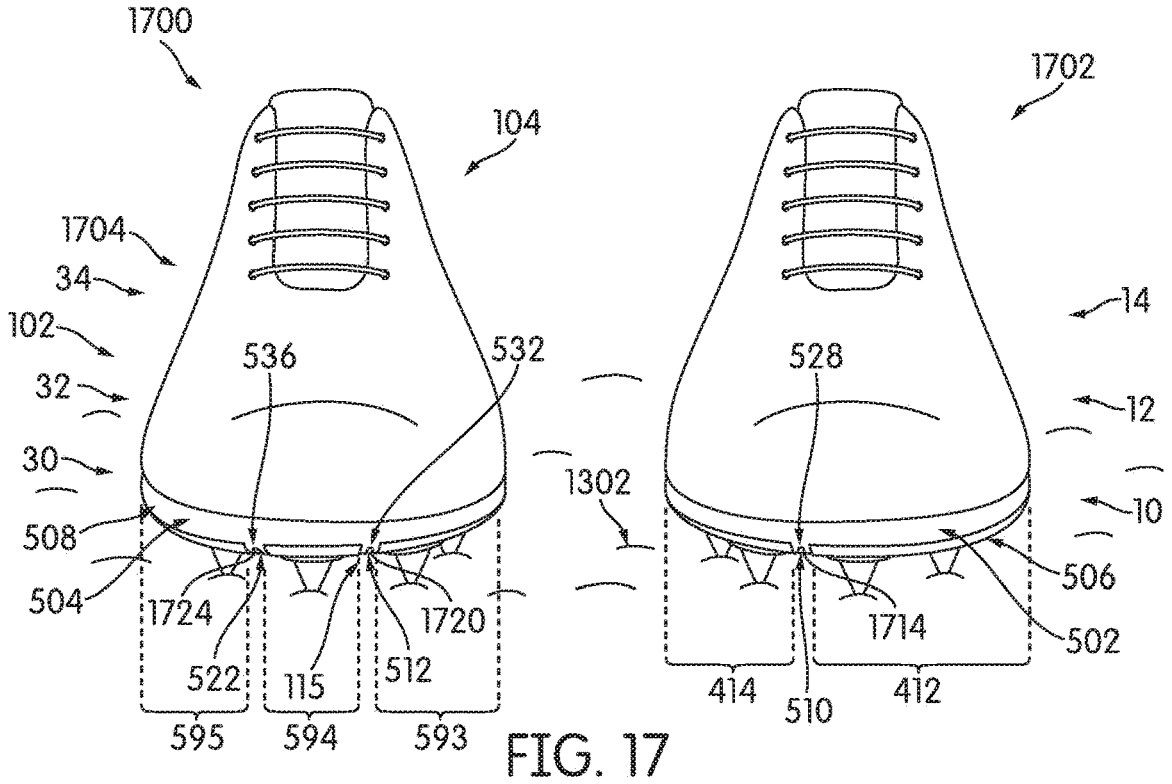
FIG. 17 is a front perspective view of an embodiment of the articles of FIG. 5.
Figure 18:
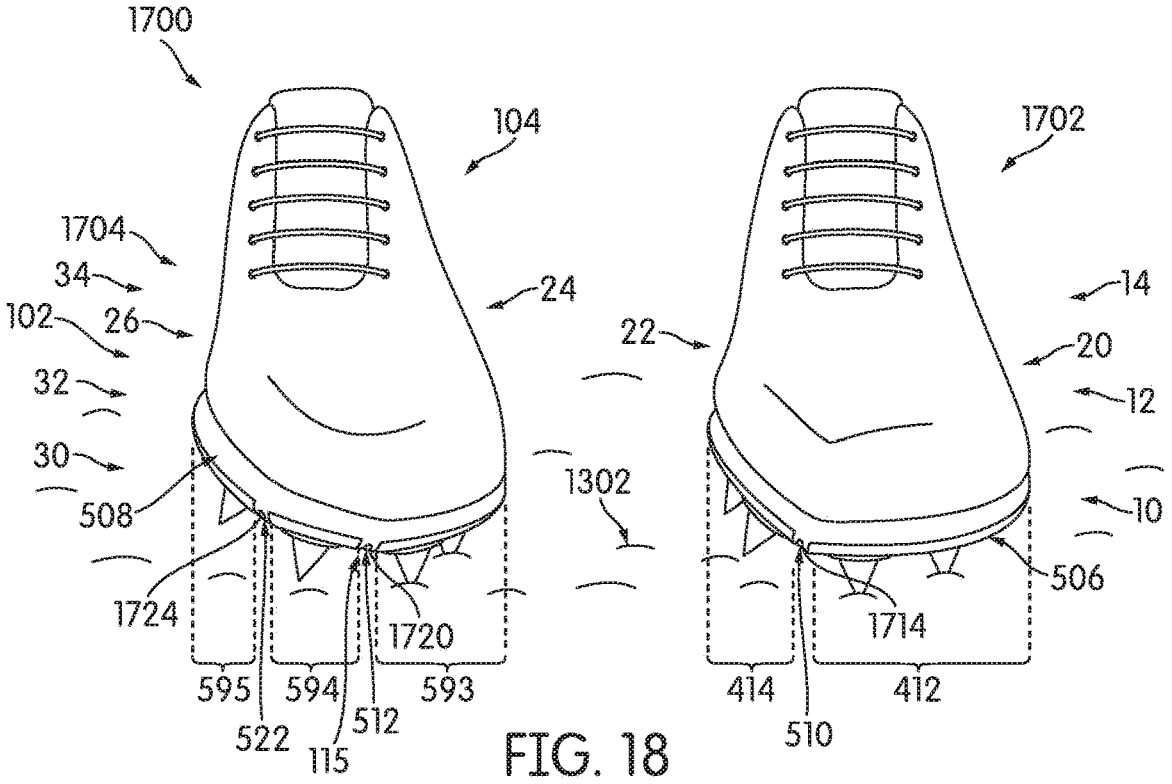
FIG. 18 is a front perspective view of an embodiment of the articles of FIG. 5.

In FIGS. 17-18, a front view of one embodiment of articles 1700 is shown, including a third article 1702 with third plate 506 and a fourth article 1704 with fourth plate 508 (third plate 506 and fourth plate 508 as previously described with reference to FIG. 5). FIGS. 17-18 represent possible regions of bending and flexibility of the sole plates. In FIG. 17, articles 1700 are shown at rest along running surface 1302. Third article 1702 has third groove 510, and fourth article 1704 has fourth groove 512 and fifth groove 522. Third groove 510 has first end 528 corresponding with a first exposed portion 1714, fourth groove 512 has a first end 532 corresponding with a second exposed portion 1720, and fifth groove 522 has a first end 536 corresponding with a third exposed portion 1724. As discussed earlier with respect to FIG. 5, third plate 506 also includes first lateral plate portion 412 and first medial plate portion 414, while fourth plate 508 includes second lateral plate portion 595, second medial plate portion 593, and intermediate plate portion 594.

In FIG. 18, articles 1700 are contacting running surface 1302 while articles 1700 experience a force. In some embodiments, the sole plates may be bent along the asymmetrical flex lines formed by grooves 115. Third article 1702, as the "inner shoe" (see FIG. 2), is shown with first lateral plate portion 412 connecting with running surface 1302, while first medial plate portion 414 (corresponding with first medial side 22) is bent upward relatively sharply along the axis formed by third groove 510. Fourth article 1704, as the "outer shoe" (see FIG. 2), is also shown with second medial plate portion 593 connecting with running surface 1302, and intermediate plate portion 594 and second lateral plate portion 595 (corresponding with second lateral side 26) being bent in a relatively gradual curve corresponding with fourth groove 512 and fifth groove 522. Furthermore, in some embodiments, first exposed portion 1714, second exposed portion 1720, and/or third exposed portion 1724 may expand in width as force is exerted along grooves 115 and bending occurs. In one embodiment, first exposed portion 1714, second exposed portion 1720, and third exposed portion 1724 may expand to facilitate the bending of the sole plates. In other embodiments, first exposed portion 1714, second exposed portion 1720, and third exposed portion 1724 may remain the same size, or become more narrow.

Thus, in different embodiments, grooves 115 can be disposed along sole plates 102 in a manner that provides improved support, performance, flexibility, balance, cushioning, and/or traction to user along a curved track or other ground surfaces.

While various embodiments have been described, the description is intended to describe examples of the invention, rather than limiting the invention, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A complementary pair of sole plates for use with a left article of footwear and a right article of footwear of a pair of shoes, the complementary pair of sole plates comprising:

a first plate for one article of footwear of the pair of shoes;

a second plate for another article of footwear of the pair of shoes;

the first plate including a first groove extending through an entire thickness of the first plate that divides a forefoot portion of the first plate into a first continuous lateral plate portion and a first continuous medial plate portion, wherein the first groove is the only groove extending completely through the first plate; and the second plate including a second groove extending through an entire thickness of the second plate and a third groove extending through the entire thickness of the second plate, wherein the second groove and the third groove are the only grooves extending through the entire thickness of the second plate, wherein the second groove and the third groove divide a forefoot portion of the second plate into a second continuous lateral plate portion, a first continuous intermediate plate portion, and a second continuous medial plate portion, and wherein the complementary pair of sole plates have an asymmetric configuration with respect to one another.

2. The complementary pair of sole plates according to claim 1, wherein: (a) an anterior end of the second groove is located at a forefoot lateral perimeter of the second plate and (b) a posterior end of the second groove is located within an interior portion of the second plate.

3. The complementary pair of sole plates according to claim 1, wherein the third groove extends from a front edge of the second plate to an interior portion of the second plate.

4. The complementary pair of sole plates according to claim 1, wherein the third groove is substantially linear.

5. The complementary pair of sole plates according to claim 1, wherein the third groove includes at least one curved region.

6. The complementary pair of sole plates according to claim 1, wherein the first plate includes a heel member.

7. The complementary pair of sole plates according to claim 1, wherein the first plate is a left foot support plate and the second plate is a right foot support plate.

8. A complementary pair of articles of footwear, comprising:

a first article of footwear and a second article of footwear forming a pair of shoes for opposite feet of a wearer;

a first forefoot support provided as part of the first article of footwear and a second forefoot support provided as part of the second article of footwear;

the first forefoot support including a first continuous lateral plate portion and a first continuous medial plate portion, wherein a first groove extends through an entire thickness of the first forefoot support and completely separates the first continuous medial plate portion from the first continuous lateral plate portion, wherein the first groove is the only groove extending completely through the first forefoot support;

the second forefoot support including a second continuous lateral plate portion, a first continuous intermediate plate portion, and a second continuous medial plate portion, wherein a second groove extends through an entire thickness of the second forefoot support and completely separates the second continuous lateral plate portion from the first continuous intermediate plate portion, wherein a third groove extends through the entire thickness of the second forefoot support and completely separates the second continuous medial plate portion from the first continuous intermediate plate portion, and wherein the second groove and the third groove are the only grooves extending through the entire thickness of the second forefoot support.

9. The complementary pair of articles of footwear according to claim 8, wherein the third groove extends from a front edge of the second article of footwear to a closed end.

10. The complementary pair of articles of footwear according to claim 9, wherein the second continuous medial plate portion and the first continuous intermediate plate portion are joined together as a single part posterior of the closed end.

11. The complementary pair of articles of footwear according to claim 8, wherein the third groove is substantially linear.

12. The complementary pair of articles of footwear according to claim 8, wherein the third groove includes at least one curved region.

13. The complementary pair of articles of footwear according to claim 8, wherein the first article of footwear is a left shoe of the pair of shoes and the second article of footwear is a right shoe of the pair of shoes.

14. The complementary pair of articles of footwear according to claim 8, wherein the first groove exposes an elongated strip of a footwear layer located adjacent and partially covered by the first continuous medial plate portion and the first continuous lateral plate portion of the first article of footwear.

15. The complementary pair of articles of footwear according to claim 8, wherein the second groove exposes an elongated strip of a footwear layer located adjacent and partially covered by the second continuous lateral plate portion and the first continuous intermediate plate portion of the second article of footwear, and wherein the third groove exposes an elongated strip of a footwear layer located adjacent and partially covered by the second continuous medial plate portion and the first continuous intermediate plate portion of the second article of footwear.

16. The complementary pair of articles of footwear according to claim 8, wherein an anterior end of the second groove is located at a lateral side of a center line of the second article of footwear, and wherein an anterior end of the third groove is located at a medial side of the center line of the second article of footwear.

17. The complementary pair of articles of footwear according to claim 8, wherein: (a) an anterior end of the first groove is located at a medial side of a center line of the first article of footwear and (b) a posterior end of the first groove is located at a midfoot region on the medial side of the center line of the first article of footwear.

18. The complementary pair of articles of footwear according to claim 8, wherein: (a) an anterior end of the second groove is located at a lateral side of a center line of the second article of footwear and (b) a posterior end of the second groove is located at a midfoot region on a medial side of the center line of the second article of footwear.

19. The complementary pair of articles of footwear according to claim 8, wherein: (a) an anterior end of the third groove is located at a forward toe end of the second article of footwear and (b) a posterior end of the third groove is a closed end.

20. The complementary pair of articles of footwear according to claim 8, wherein: (a) an anterior end of the first groove is located at a lateral side of a center line of the first article of footwear and (b) a posterior end of the first groove is located at a midfoot region on the lateral side of the center line of the first article of footwear.

* * * * *